US005545373A

United States Patent [19]

Maziasz et al.

[11] Patent Number: 5,545,373

[45] Date of Patent: Aug. 13, 1996

[54] HIGH-TEMPERATURE CORROSION-RESISTANT IRON-ALUMINIDE (FEAL) ALLOYS EXHIBITING IMPROVED WELDABILITY

[75] Inventors: Philip J. Maziasz, Oak Ridge; Gene M. Goodwin, Lenoir City; Chain T. Liu, Oak Ridge, all of Tenn.

[73] Assignee: Martin Marietta Energy Systems, Inc., Oak Ridge, Tenn.

[21] Appl. No.: 301,238

[22] Filed: Sep. 6, 1994

Related U.S. Application Data

[63] Continuation-in-part of Ser. No. 199,116, Feb. 22, 1994, abandoned, which is a continuation of Ser. No. 884,530, May 15, 1992, Pat. No. 5,320,802.

[51] Int. Cl.[6] ..... C22C 38/06

[52] U.S. Cl. ..... 420/81

[58] Field of Search ..... 420/81

[56] References Cited

U.S. PATENT DOCUMENTS

| | | | |
|---|---|---|---|
| 4,961,903 | 10/1990 | McKamey et al. | 420/79 |
| 5,084,109 | 1/1992 | Sikka | 148/12 R |
| 5,320,802 | 6/1994 | Liu et al. | 420/81 |

OTHER PUBLICATIONS

P. F. Tortorelli and P. S. Bishop, *Influences of Compositional Modification on the Corrosion of Iron Aluminides by molten Nitrate Salts,* published Jan. 1991.

D. J. Gaydosh, S. L. Draper, and M. V. Nathal, "Microstructure and Tensile Properties of Fe–40 At. Pct. Al Alloys with C, Zr, Hf, and B Additions", *Metallurgical Transactions,* vol. 20A, Sep. 1989.

C. G. McKamey, J. H. DeVan, P. F. Torortelli, and V. K. Sikka; *A review of recent developments in Fe–l–based alloys,* J. Mater Res., vol. 6, No. 8, Aug. 1991.

A. G. Rozner and R. J. Wasilewski; "Tensile Properties of NiAl and NiTi" *Journal of the Institute of Metals,* vol. 94, 1966.

*Primary Examiner*—Deborah Yee

*Attorney, Agent, or Firm*—David E. LaRose; J. D. Griffin; H. W. Adams

[57] ABSTRACT

This invention relates to improved corrosion-resistant iron-aluminide intermetallic alloys. The alloys of this invention comprise, in atomic percent, from about 30% to about 40% aluminum alloyed with from about 0.1% to about 0.5% carbon, no more than about 0.04% boron such that the atomic weight ratio of boron to carbon in the alloy is in the range of from about 0.01:1 to about 0.08:1, from about 0.01 to about 3.5% of one or more transition metals selected from Group IVB, VB, and VIB elements and the balance iron wherein the alloy exhibits improved resistance to hot cracking during welding.

26 Claims, 13 Drawing Sheets

HIGH-TEMPERATURE CORROSION-RESISTANT IRON-ALUMINIDE (FEAL) ALLOYS EXHIBITING IMPROVED WELDABILITY

The U.S. Government has rights in this invention pursuant to Contract No. DE-ACO5-840R21400 between the U.S. Department of Energy—Advanced Industrial Materials (AIM) Program, and Martin Marietta Energy Systems, Inc.

The present invention is a continuation-in-part application of U.S. patent application Ser. No. 08/199,116 filed Feb. 22, 1994 which is a continuation of U.S. patent application Ser. No. 07/884,530 filed May 15, 1992, now U.S. Pat. No. 5,320,802, the disclosure of which is incorporated herein by reference.

BACKGROUND

The present invention relates generally to metal alloy compositions, and more particularly to corrosion-resistant ordered intermetallic iron-aluminide alloys, which exhibit improved weldability while maintaining their mechanical properties, in particular, iron-aluminide alloys possessing better hot-cracking resistance as compared to previous alloys.

Iron-aluminides (particularly FeAl-type alloys with >30 at. % Al) have been found to be more resistant to many forms of high-temperature oxidation, sulfidation, exposure to nitrate salts and other corrosive environments than many iron-based corrosion-resistant Fe—Cr—Ni—Al alloys or nickel-based superalloys. In the past, the use of FeAl-type iron-aluminide alloys has been limited by their low ductility and brittleness at room-temperature, poor high-temperature strength above 600 ° C., and poor weldability.

It has been observed that generally optimum mechanical properties (including room-temperature ductility, and high-temperature tensile-yield and creep-rupture strengths) of $Fe_3Al$ and FeAl type iron-aluminides do not generally coincide with optimum weldability. One measure of relative weldability has been to qualitatively describe whether or not cracking occurs during unrestrained welding ( hot-cracking ), but recently, a testing device (Sigmajig) has been developed that quantitatively determines hot-cracking susceptibility of alloys and metals by measuring the threshold cracking stress ($\sigma_o$) obtained by restrained welding with different applied stresses. There is a need for improved weldability to enable the use of FeAl alloys which have exceptional corrosion resistance in place of conventional structural materials, such as stainless steel. There also is a need for improved weldability of FeAl alloys to make them suitable for structural applications compared to less weldable iron-aluminide alloys. Such structural applications also require that the FeAl alloys possess improved mechanical properties such as high tensile strength and low creep rates. In addition, there is a need for improved weldability of FeAl alloys so that such alloys can be used as filler-metals to weld and join other FeAl type alloys that are useful for structural applications. Such improved FeAl alloys may be useful as an inherently corrosion-resistant weld-overlay cladding on a different structural metal substrate.

Accordingly, it is the object of the present invention to provide an improved FeAl-type metal alloy composition.

Another object of the invention is to provide an improved alloy of the character described that has improved weldability.

It is another object of the invention to provide a weldable alloy of the character described that has acceptable resistance to oxidation, sulfidation, molten nitrate salt corrosion and other forms of chemical attack in high-temperature service environments.

Another object of the invention is to provide a weldable alloy of the character described which also provides an acceptable combination of oxidation/corrosion resistance and mechanical properties.

A further object of the invention is to provide a weldable alloy of the character described which also exhibits sufficient high-temperature strength and fabricability for structural use.

Still another object of the invention is to provide improved weldability of FeAl-type iron-aluminide alloys of the character described for use as weld filler-metal and as weld-overlay cladding material.

Yet another object of this invention is to provide methods for making weld-consumables for metal compositions having the aforementioned attributes.

SUMMARY OF THE INVENTION

Having regard to the above and other objects, features and advantages, the present invention is directed to a high-temperature, corrosion-resistant intermetallic alloy which exhibits improved weldability while maintaining its mechanical strength and ductility. Such alloys may be useful for structural, weld filler-metal, and for weld-overlay cladding applications. In general, the alloy of this invention comprises, in atomic percent, an FeAl type iron-aluminide alloy containing from about 30% to about 40% aluminum, alloyed with from about 0.1 to about 0.5% carbon and the balance iron.

The FeAl iron-aluminide alloys of the invention exhibit superior weldability as measured by their resistance to hot cracking during welding. The alloys of the present invention also exhibit resistance to chemical attack resulting from exposure to strong oxidants at elevated temperatures, high temperature oxidizing and sulfidizing substances (e.g., flue-gas-desulfurization processes, exposure to high temperature oxygen/chlorine mixtures, and in certain aqueous or molten salt solutions). Furthermore, the high temperature mechanical properties, including elongation, creep and tensile strength, of the alloys of this invention are characteristic of such FeAl alloys.

Further improvements in weldability of the FeAl iron-aluminide alloys of the invention are achieved by further alloying with and from about 0.01% to about 3.5% of one or more transition metals selected from the Group IVB, VB and VIB elements. Addition of one or more transition metals to the above-described alloys yields alloys having improved corrosion resistance and/or high-temperature strength. In the alternative, the one or more transition metals can be constituents of other iron-aluminide alloys being joined with the alloys of this invention for use as a filler metal, or the one or more transition metals can be constituents of other base-metals for use as a weld-overlay cladding.

The foregoing and other features and advantages of the present invention will now be described in detail with reference to the accompanying drawings.

DETAILED DESCRIPTION OF THE INVENTION

Figure 1:
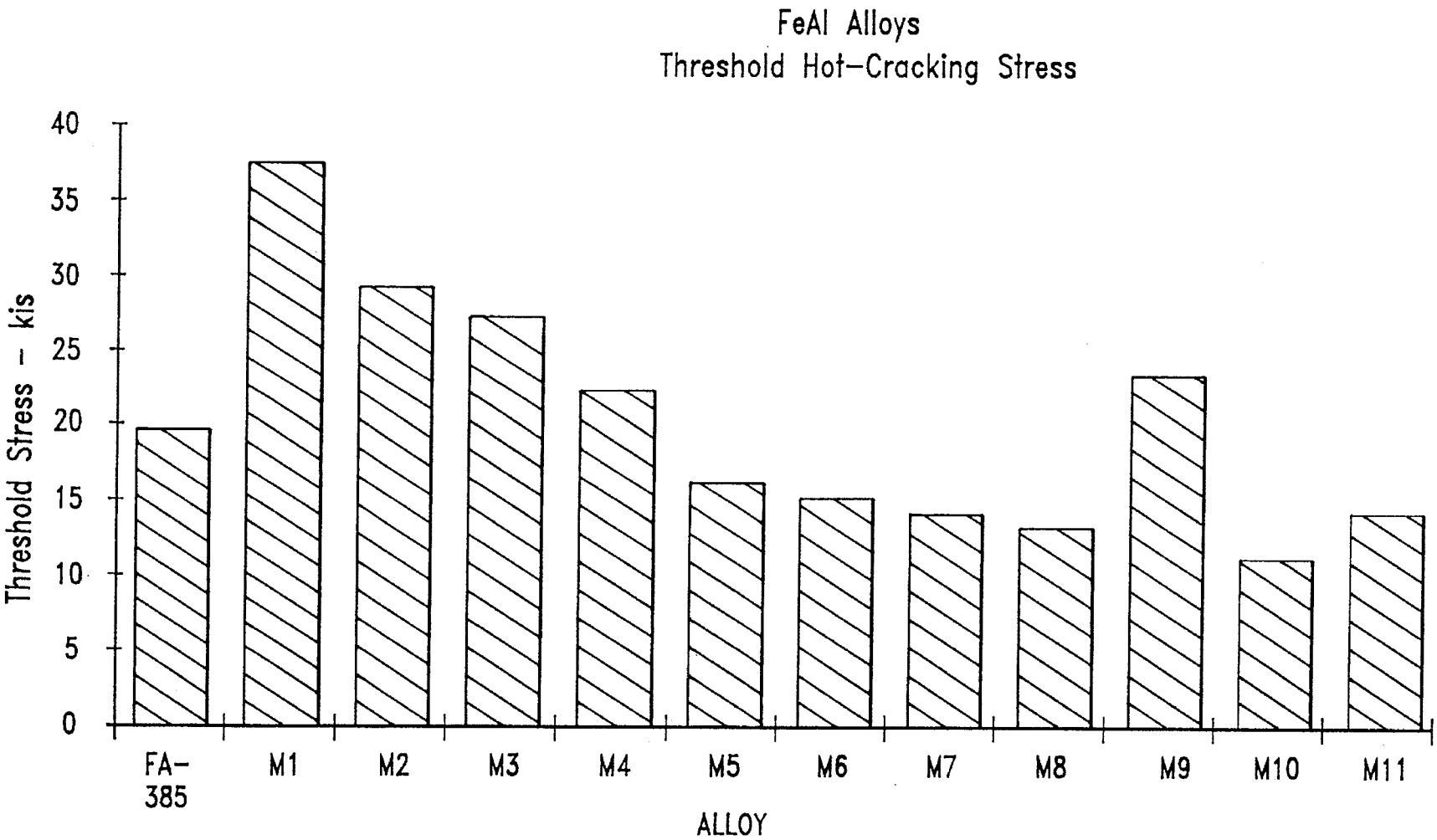
FIG. 1 is a graphical view illustrating the threshold cracking stress of various FeAl alloys.

The present invention may be generally described as an intermetallic alloy having an FeAl iron-aluminide base containing (in atomic percent) from about 30 to about 40% aluminum alloyed with from about 0.1% or more carbon, from about 0.01% to about 3.5% of one or more transition metals selected from Group IVB, VB, and VIB elements and the balance iron. The transition metals useful in the compositions of this invention are selected from chromium, molybdenum, niobium, titanium, tungsten and zirconium.

In a preferred embodiment, the invention provides a corrosion resistant intermetallic alloy comprising, in atomic percent, an FeAl iron-aluminide containing from about 30% to about 40% aluminum alloyed with from about 0.1% to about 0.5% carbon, from about 0.01% to about 3.5% of one or more transition metals selected from Group IVB, VB and VIB elements and the balance iron, wherein the alloy exhibits improved resistance to hot cracking during welding.

In another preferred embodiment, the invention provides a weldable intermetallic alloy comprising, in atomic percent, an FeAl iron-aluminide containing from about 30% to about 40% aluminum alloyed with a synergistic combination of carbon and chromium wherein the carbon content is in the range of from about 0.1% to about 0.5% and the chromium content is up to about 3%, the balance being iron.

In yet another preferred embodiment, the invention provides a weldable intermetallic alloy comprising, in atomic percent, an FeAl iron-aluminide containing from about 30% to about 40% aluminum alloyed with a synergistic combination of carbon and niobium wherein the carbon content is in the range of from about 0.1% to about 0.5% and the niobium content is up to about 2%, the balance being iron.

In still another preferred embodiment, the invention provides a weldable intermetallic alloy comprising, in atomic percent, an FeAl iron-aluminide containing from about 30% to about 40% aluminum alloyed with no more than about 0.04% boron, from about 0.1% to about 0.5% carbon and the balance iron, wherein the atomic weight ratio of boron to carbon in the alloy is from about 0.01:1 to about 0.08:1.

In a particularly preferred embodiment, the invention provides a weldable intermetallic alloy comprising, in atomic percent, an FeAl iron-aluminide containing from about 30% to about 40% aluminum alloyed with no more than about 0.04% boron, from about 0.1% to about 0.5% carbon wherein the atomic weight ratio of boron to carbon in the alloy is from about 0.01:1 to about 0.08:1, from about 0.01% to about 3.5% of one or more transition metals selected from Group IVB, VB and VIB elements and the balance iron, wherein the alloy exhibits improved resistance to hot cracking during welding.

As used herein, the terminology "intermetallic alloy" or "ordered intermetallic alloy" refers to a metallic composition in which two or more metallic elements react to form a compound that has an ordered superlattice structure. The term "iron-aluminide" refers to a broad range of different ordered intermetallic alloys whose main constituents are iron and aluminum in different atomic proportions, including $Fe_3Al$, $Fe_2Al$, FeAl, $FeAl_2$, $FeAl_3$, and $Fe_2Al_5$. The present invention is particularly directed to an iron-aluminide alloy based on the FeAl phase, which has an ordered body-centered-cubic B2 crystal structure. As used herein, the terminology "FeAl iron-aluminide alloy" refers to an intermetallic composition with predominantly the B2 phase.

It has been discovered that the addition of one or more transition metals to an iron-aluminide alloy containing from about 0.1% to about 0.5% carbon may have a synergistic effect with the carbon to improve the weldability of iron-aluminide alloys. Particularly useful transition metals may be selected from chromium, molybdenum, niobium, titanium, tungsten and zirconium. One such synergistic combination contains up to about 2% niobium. Another synergistic combination contains up to about 3% chromium. Still another synergistic combination contains up to about 2% niobium, up to about 3% chromium and from about 0.05% up to about 0.1% titanium. It is preferred that the alloy not contain both chromium and niobium unless the alloy also contains titanium and more than about 0.15% carbon. Accordingly, in some high-temperature applications, the alloy preferably contains both chromium and niobium in the above mentioned proportions and at least about 0.05% titanium and more than about 0.15% carbon.

A novel feature of this invention not demonstrated previously is the positive synergistic effect of carbon when added together with chromium or niobium on weldability of FeAl alloys. In order to demonstrate the apparent synergistic effect and the benefits thereof, the following compositions were prepared and the weldability and mechanical properties of the alloys were tested:

TABLE 1

| | FeAl Iron-Aluminide Alloys Containing 21.2% Al (wt. %) | | | | | | | | | | |
|---|---|---|---|---|---|---|---|---|---|---|---|
| Alloy | Zr | Mo | B | C | Cr | Nb | Ti | W | Ni | Si | P |
| FA-324 | — | — | — | — | — | — | — | — | — | — | — |
| FA-350 | 0.1 | — | 0.05 | — | — | — | — | — | — | — | — |
| FA-362 | 0.1 | 0.42 | 0.05 | — | — | — | — | — | — | — | — |
| FA-372 | 0.1 | 0.42 | — | — | — | — | — | — | — | — | — |
| FA-383 | 0.1 | — | — | — | — | — | — | — | — | — | — |

TABLE 1-continued

| FeAl Iron-Aluminide Alloys Containing 21.2% Al (wt. %) | | | | | | | | | | | |
|---|---|---|---|---|---|---|---|---|---|---|---|
| Alloy | Zr | Mo | B | C | Cr | Nb | Ti | W | Ni | Si | P |
| FA-384 | 0.1 | 0.42 | — | — | 2.3 | — | — | — | — | — | — |
| FA-385 | 0.1 | 0.42 | — | 0.03 | — | — | — | — | — | — | — |
| FA-386 | 0.1 | 0.42 | — | 0.06 | — | — | — | — | — | — | — |
| FA-387 | — | 0.42 | 0.05 | — | — | — | — | — | — | — | — |
| FA-388 | — | 0.42 | — | 0.06 | — | — | — | — | — | — | |
| M1 | 0.1 | 0.42 | 0.0025 | 0.03 | — | — | — | — | — | — | — |
| M2 | 0.1 | 0.42 | 0.005 | 0.03 | — | — | — | — | — | — | — |
| M3 | 0.1 | 0.42 | — | 0.03 | 2.3 | — | — | — | — | — | — |
| M4 | 0.1 | 0.42 | — | 0.03 | — | 1 | — | — | — | — | — |
| M5 | 0.1 | 0.42 | — | 0.03 | 2.3 | 1 | — | — | — | — | — |
| M6 | 0.1 | 0.42 | — | 0.06 | 2.3 | 1 | — | — | — | — | — |
| M7 | 0.2 | 0.42 | — | 0.06 | 2.3 | 1 | — | — | — | — | — |
| M8 | 0.1 | 0.42 | — | 0.03 | 2.3 | 1 | 0.05 | — | — | — | — |
| M9 | 0.1 | 0.42 | — | 0.06 | 2.3 | 1 | 0.05 | — | — | — | — |
| M10 | 0.1 | 0.42 | — | 0.03 | 2.3 | 1 | 0.05 | — | 0.65 | 0.17 | 0.01 |
| M11 | 0.1 | 0.42 | — | 0.03 | 2.3 | 1 | 0.05 | 1 | — | — | — |

TABLE 1A

| FeAl Iron-Aluminide Alloys Containing 35.8% Al (at. %) | | | | | | | | | | | |
|---|---|---|---|---|---|---|---|---|---|---|---|
| Alloy | Zr | Mo | B | C | Cr | Nb | Ti | W | Ni | Si | P |
| FA-324 | — | — | — | — | — | — | — | — | — | — | — |
| FA-350 | 0.05 | — | 0.24 | — | — | — | — | — | — | — | — |
| FA-362 | 0.05 | 0.2 | 0.24 | — | — | — | — | — | — | — | — |
| FA-372 | 0.05 | 0.2 | — | — | — | — | — | — | — | — | — |
| FA-383 | 0.05 | — | — | — | — | — | — | — | — | — | — |
| FA-384 | 0.03 | 0.2 | — | — | 2.0 | — | — | — | — | — | — |
| FA-385 | 0.05 | 0.2 | — | 0.13 | — | — | — | — | — | — | — |
| FA-386 | 0.05 | 0.2 | — | 0.24 | — | — | — | — | — | — | — |
| FA-387 | — | 0.2 | 0.24 | — | — | — | — | — | — | — | — |
| FA-388 | — | 0.2 | — | 0.25 | — | — | — | — | — | — | — |
| M1 | 0.05 | 0.2 | 0.01 | 0.13 | — | — | — | — | — | — | — |
| M2 | 0.05 | 0.2 | 0.021 | 0.13 | — | — | — | — | — | — | — |
| M3 | 0.05 | 0.2 | — | 0.13 | 2.0 | — | — | — | — | — | — |
| M4 | 0.05 | 0.2 | — | 0.13 | — | 0.5 | — | — | — | — | — |
| M5 | 0.05 | 0.2 | — | 0.13 | 2.0 | 0.5 | — | — | — | — | — |
| M6 | 0.05 | 0.2 | — | 0.25 | 2.0 | 0.5 | — | — | — | — | — |
| M7 | 0.1 | 0.2 | — | 0.25 | 2.0 | 0.5 | — | — | — | — | — |
| M8 | 0.05 | 0.2 | — | 0.13 | 2.0 | 0.5 | 0.05 | — | — | — | — |
| M9 | 0.05 | 0.2 | — | 0.25 | 2.0 | 0.5 | 0.05 | — | — | — | — |
| M10 | 0.05 | 0.2 | — | 0.13 | 2.0 | 0.5 | 0.05 | — | 0.5 | 0.3 | 0.016 |
| M11 | 0.05 | 0.2 | — | 0.13 | 2.0 | 0.5 | 0.05 | 0.25 | — | — | — |

TABLE 1B

| FeAl Iron-Aluminide Alloys Containing 16.9% Al (wt. %) | | | | | | |
|---|---|---|---|---|---|---|
| Alloy | Zr | Mo | B | C | Cr | Ti |
| FA-30M1 | 0.1 | 0.42 | 0.005 | 0.03 | — | — |
| FA-30M2 | 0.1 | 0.42 | 0.005 | 0.05 | — | 0.05 |
| FA-30M3 | 0.1 | 1.0 | 0.005 | 0.05 | 2.2 | 0.05 |

TABLE 1C

| FeAl Iron-Aluminide Alloys Containing 30% Al (at. %) | | | | | | |
|---|---|---|---|---|---|---|
| Weld Rod Alloys | Zr | Mo | B | C | Cr | Ti |
| FA-30M1 | 0.05 | 0.2 | 0.021 | 0.22 | — | — |
| FA-30M2 | 0.05 | 0.2 | 0.021 | 0.22 | — | 0.05 |
| FA-30M3 | 0.05 | 0.48 | 0.021 | 0.22 | 2.0 | 0.05 |

To demonstrate the weldability of FeAl alloys, the threshold stress ($\sigma_o$) necessary to cause hot-cracking during gas tungsten-arc (GTA) welding was determined using a Sigmajig apparatus. The results of these weldability tests are contained in Table 2 and are illustrated in FIG. 1.

TABLE 2

| Threshold Hot-Cracking Stress Data | | |
|---|---|---|
| Alloy | $\sigma_o$(ksi) | $\sigma_o$(MPa) |
| FA-388 | 18 | 124 |
| FA-385 | 20 | 138 |
| M1 | 37 | 255 |
| M2 | 29 | 200 |
| M3 | 27 | 186 |
| M4 | 22 | 151 |
| M5 | 16 | 110 |
| M6 | 15 | 103 |
| M7 | 14 | 96 |
| M8 | 13 | 90 |

TABLE 2-continued

| Threshold Hot-Cracking Stress Data | | |
|---|---|---|
| Alloy | $\sigma_o$(ksi) | $\sigma_o$(MPa) |
| M9 | 23 | 158 |
| M10 | 11 | 76 |
| M11 | 14 | 96 |

Table 2 and FIG. 1 illustrate that the M3 alloy with chromium (Mo+Zr+2%Cr+0.13%C) has very good weldability ($\sigma_o$=27 ksi) as compared to the base alloy FA-385. Likewise the M4 alloy with niobium still has good weldability ($\sigma_o$=22 ksi) as compared to the FA-385 base alloy. However, weldability apparently becomes worse in the M5, M6 and M7 alloys ($\sigma_o$=14–16 ksi) when chromium and niobium are combined, despite the presence of 0.13–0.25% carbon. The addition of titanium alone does not appear to improve weldability with a carbon content of 0.13% as illustrated by comparison of the M8 alloy with the M5, M6, and M7 alloys. However, when the carbon content is increased to 0.25%, the weldability improves considerably as illustrated by comparing the M9 alloy with the M8 alloy ($\sigma_o$=23 ksi and =13 ksi, respectively). Further comparison of the M6 and M9 alloys demonstrates that improved weldability is due to an apparent synergism between titanium and carbon. Given the low weldability of the M8 alloy, the additions of small amounts of silicon, nickel, phosphorus or tungsten should not be harmful to weldability, but they also have no apparent positive additive or synergistic effects. (Compare the M10 and M11 alloys with the M9 alloy).

It has also been discovered that the addition of a micro-alloying amount of boron with larger amounts of carbon such that the atomic weight ratio of boron to carbon ranges from 0.01:1 to about 0.08:1 has particular beneficial effects on the weldability of iron-aluminide alloys having an aluminum content in the range of from about 30% to about 40% on an atomic weight percent basis. Such alloys need not contain chromium or niobium. In such case, the boron content of the alloy is preferably no more than about 0.04% and most preferably not more than about 0.02%. Anomalistically good hot-cracking resistance ($\sigma_o$=37 ksi) was shown for the FeAl alloy M1 which contained 0.01% added boron, and very good weldability ($\sigma_o$=29 ksi) was shown for the M2 alloy with 0.021% added boron (Table 2, FIG. 1).

The weldability of alloys containing up to about 0.03% boron is quite surprising and unexpected. Previous qualitative work on the weldability of the base FeAl, showed that FeAl alloys containing 0.24% or more of boron, or no boron at all (<0.001%) were found to hot-crack badly. A comparison of weldability of various allows containing 0.0 and 0.24% boron are contained in Table 3.

TABLE 3

| Autogenous Weldability Data | | | | |
|---|---|---|---|---|
| Alloy | boron (at. %) | Unrestrained GTA Welding | Threshold Hot-Cracking Stress ($\sigma_o$) | Low-Temperature Cold-cracking |
| FA-362 | 0.24 | hot cracks | — | — |
| FA-372 | 0.0 | some hot cracks | 96 MPa | — |
| FA-383 | 0.0 | some hot cracks | — | — |
| FA-384 | 0.0 | some hot cracks | — | — |
| FA-385 | 0.0 | no hot cracks | 238 MPa | Yes |
| FA-386 | 0.0 | no hot cracks | — | Yes |
| FA-387 | 0.24 | severe hot cracks | — | — |
| FA-388 | 0.0 | no hot cracks | 152 MPa/ 124 MPa | Yes |

Subsequent quantitative Sigmajig testing to measure the threshold hot-crack stresses ($\sigma_o$) of these same alloys showed that an alloy (FA-372 or FA-384) containing no boron and containing molybdenum and zirconium exhibited some hot-cracking and had a threshold stress below 15 ksi, whereas two of the alloys (FA-385 and FA-386) having no boron but containing 0.12% carbon or 0.24% carbon had threshold hot-cracking stress values that ranged from 18 to 22 ksi. Weldability studies using the Sigmajig to quantify the relative weldability of commercial heat-and corrosion-resistant structural alloys like 300 series austenitic stainless steels demonstrated that threshold hot-cracking stress values of 20–25 ksi indicate good weldability, and values above 25 ksi indicate very good weldability, whereas values of 15 ksi or below generally indicate unacceptable weldability. While our previous U.S. Pat. No. 5,320,802 identified positive benefits of adding carbon to FeAl alloys for weldability, and the clear detrimental effects of too much boron on weldability, an important novelty of this invention is the demonstrated synergistic effect of micro-alloying levels of boron (0.01% to 0.03%) combined with carbon additions on weldability of FeAl alloys.

Aside from the improvement in weldability, the alloys of this invention also exhibit good mechanical workability characteristics. In the following Tables 4 through 4G and FIGS. 2 through 5, the tensile properties of hot-rolled alloys of this invention are compared with the base FeAl iron-aluminide alloy (FA-385) and other FeAl alloys tested both at room temperature and at a temperature of 600° C. In the tables, the samples were hot rolled (HR) or extruded and were heat treated under the indicated conditions. In the FIG. 5, the M1 alloy was annealed at 1050° C. rather than 1000° C.

Figure 2:
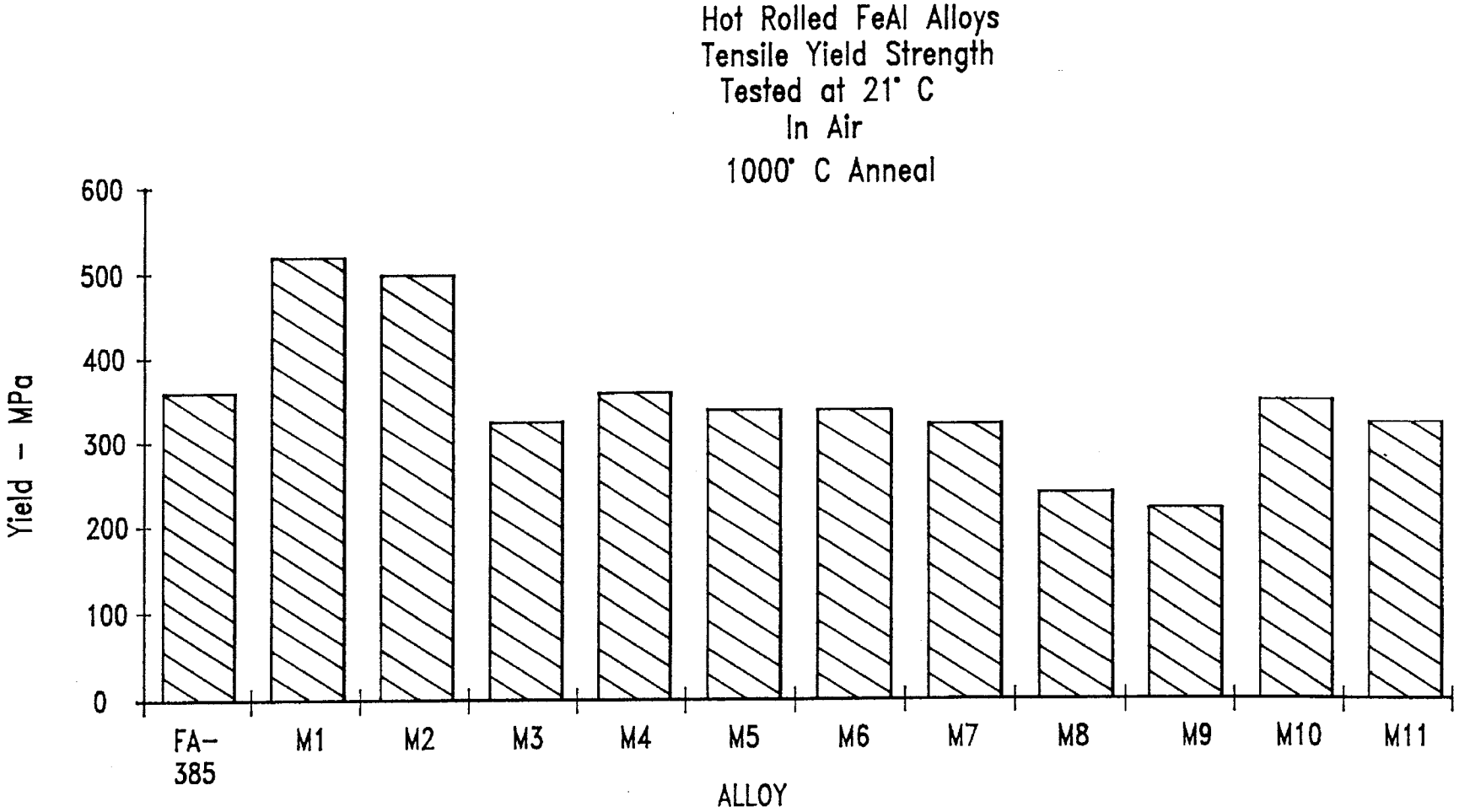
FIGS. 2 and 4 are graphical views illustrating the tensile yield strength of several hot-rolled FeAl alloys tested at room temperature in air and in oxygen with various anneal temperatures.
Figure 4:
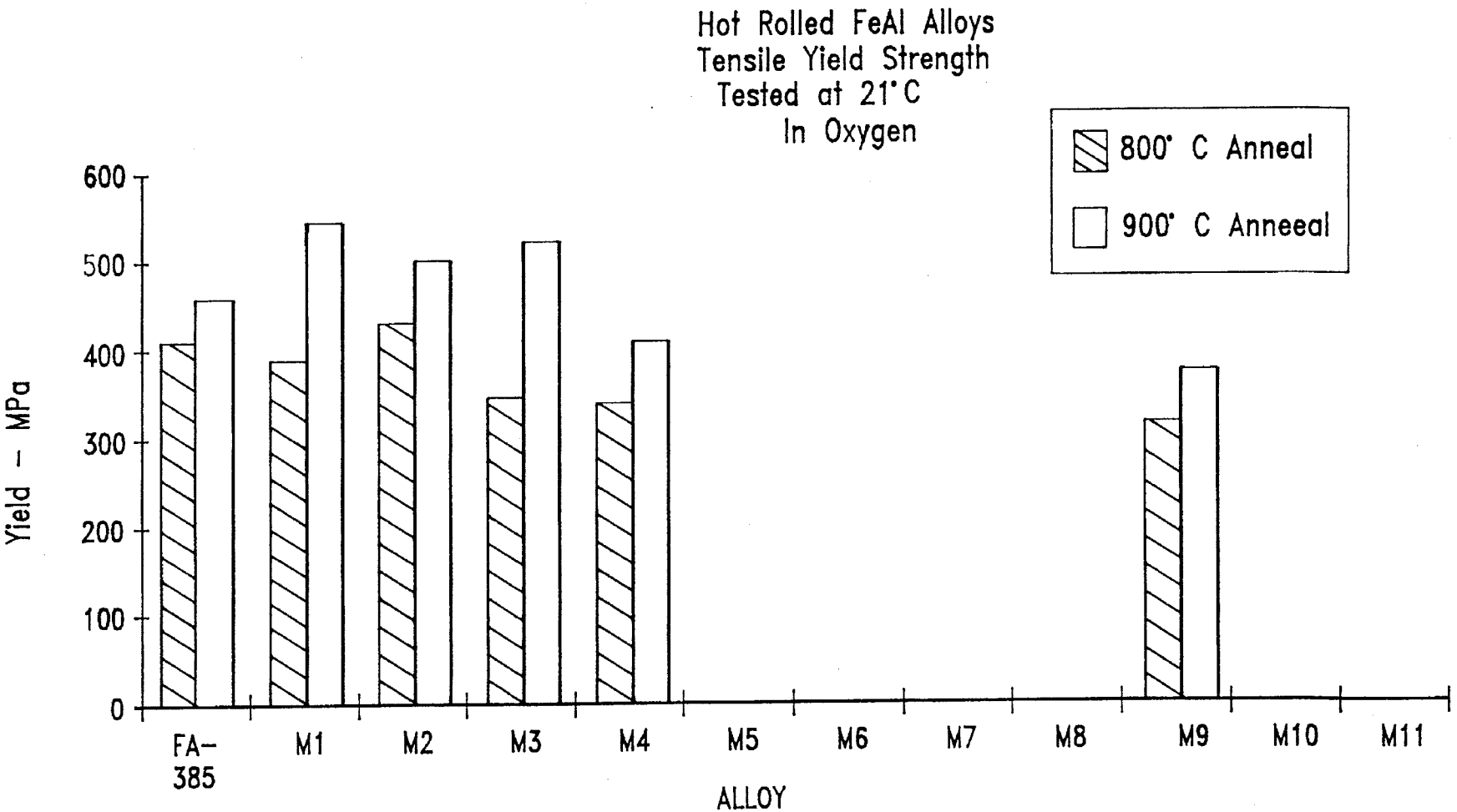

Room temperature tensile date for hot-rolled alloy materials is given in Tables 4, 4A, and 4B and FIGS. 2 and 4. This data includes measurements of environmental embrittlement due to the moisture in air. Such data is generated by testing the alloys in dry oxygen and comparing the results of alloys tested in moist air.

TABLE 4

| Tensile Properties of FeAl Alloys at Room Temperature | | | | | |
|---|---|---|---|---|---|
| | Fabrication | Room Temperature (22° C.) | | | |
| Alloy | Heat Treatment Conditions | Yield (MPa) | Ultimate (MPa) | Elongation (%) | Test Environment |
| FA-324 | 1h-800°/1h-700° C. | 355 | 409 | 2.2 | air |
| | 1h-800°/1h-700° C. | 334 | 621 | 7.6[1] | air |
| FA-350 | 1h-800°/1h-700° C. | 300 | 442 | 4.5 | air |
| | 1h-800°/1h-700° C. | 323 | 754 | 10.7[1] | air |
| FA-362 | 1h-800°/1h-700° C. | 400 | 836 | 11.8[1] | air |
| | 1h-800°/1h-700° C. | 400 | 643 | 6.0 | air |
| | 1h-800°/1h-700° C. | 372 | 630 | 6.1 | air |
| FA-372 | 1h-800°/1h-700° C. | 340 | 634 | 7.8[1] | air |
| | 1h-800°/1h-700° C. | 343 | 563 | 6.4 | air |
| | 1h-800°/1h-700° C. | 337 | 498 | 4.6 | air |
| FA-383 | 1h-800°/1h-700° C. | 292 | 344 | 2.9 | air |
| | 1h-800°/1h-700° C. | 330 | 425 | 2.9 | air |
| FA-384 | 1h-800°/1h-700° C. | 318 | 365 | 1.6 | air |
| | 1h-800°/1h-700° C. | 316 | 368 | 2.2 | air |
| FA-385 | 1h-800°/1h-700° C. | 336 | 519 | 4.4 | air |
| | 1h-800°/1h-700° C. | 357 | 483 | 3.3 | air |
| | HR-900°/1h-800° C. | 404 | 755 | 13.5 | oxygen |
| | HR-900°/1h-900° C. | 450 | 782 | 10.5 | oxygen |
| | HR-900°/1h-900° C. | 337 | 337 | <0.1 | air |
| | HR-900°/1h-900° C. | 440 | 440 | <0.1 | air |
| | HR-900°/1h-1000° C. | 420 | 809 | 14.7 | oxygen |
| | HR-200°/1h-1000° C. | 417 | 465 | 1.8 | air |
| | HR-900°/1h-1000° C. | 304 | 304 | <0.1 | air |
| | HR-900°/1h-1000° C. | 401 | 480 | 1.6 | vacuum |
| | HR-900°/1h-1050° C. | 481 | 481 | <0.1 | air |
| | HR-900°/1h-1050° C. | 465 | 521 | 0.9 | vacuum |
| | HR-900°/1h-1100° C. | 408 | 662 | 7.8 | oxygen |

[1]Bar samples, all others are sheet samples.

TABLE 4A

| Tensile Properties of FeAl Alloys at Room Temperature | | | | | |
|---|---|---|---|---|---|
| | Fabrication | Room Temperature (22° C.) | | | |
| Alloy | Heat Treatment Conditions | Yield (MPa) | Ultimate (MPa) | Elongation (%) | Test Environment |
| FA-386 | 1h-800° C./1h-700° C. | 323 | 428 | 2.7 | air |
| | 1h-800° C./1h-700° C. | 326 | 467 | 3.5 | air |
| FA-387 | 1h-800° C./1h-700° C. | 381 | 550 | 4.1 | air |
| | 1h-800° C./1h-700° C. | 376 | 616 | 6.2 | air |
| FA-388 | 1h-800° C./1h-700° C. | 318 | 406 | 1.8 | air |
| | 1h-800° C./1h-700° C. | 315 | 355 | 1.3 | air |
| | HR-900° C./1h-1000° C. | 434 | 434 | <0.1 | air |
| M1 | HR-900°/1h-800° C. | 381 | 801 | 12.3 | oxygen |
| | HR-900°/1h-900° C. | 536 | 867 | 11.1 | oxygen |
| | HR-900°/1h-1000° C. | 439 | 703 | 7.5 | oxygen |
| | HR-900°/1h-1000° C. | 518 | 518 | <0.1 | air |
| | HR-900°/1h-1000° C. | 511 | 566 | 1.5 | vacuum |
| | HR-900°/1h-1050° C. | 504 | 504 | <0.1 | air |
| | HR-900°/1h-1050° C. | 499 | 554 | 0.8 | vacuum |
| | HR-900°/1h-1100° C. | 518 | 826 | 10.1 | oxygen |
| M2 | HR-900°/1h-800° C. | 421 | 780 | 13.8 | oxygen |
| | HR-900°/1h-900° C. | 492 | 943 | 14.7 | oxygen |
| | HR-900°/1h-900° C. | 382 | 382 | <0.1 | air |
| | HR-900°/1h-1000° C. | 508 | 663 | 3.8 | oxygen |
| | HR-900°/1h-1000° C. | 467 | 533 | 2.0 | air |
| | HR-900°/1h-1000° C. | 525 | 525 | <0.1 | air |
| | HR-900°/1h-1000° C. | 515 | 523 | 0.7 | vacuum |
| | HR-900°/1h-1050° C. | 198 | 198 | <0.1 | air |
| | HR-900°/1h-1050° C. | 519 | 596 | 2.3 | vacuum |
| | HR-900°/1h-1100° C. | 501 | 720 | 7.2 | oxygen |

TABLE 4B

Tensile Properties of FeAl Alloys at Room Temperature

| Alloy | Fabrication Heat Treatment Conditions | Room Temperature (22° C.) Yield (MPa) | Ultimate (MPa) | Elongation (%) | Test Environment |
|---|---|---|---|---|---|
| M3 | HR-900°/1h-800° C. | 339 | 739 | 14.1 | oxygen |
| | HR-900°/1h-900° C. | 512 | 812 | 8.7 | oxygen |
| | HR-900°/1h-1000° C. | 486 | 634 | 4.3 | oxygen |
| | HR-900°/1h-1000° C. | 461 | 473 | 1.1 | air |
| | HR-900°/1h-1000° C. | 192 | 192 | <0.1 | air |
| | HR-900°/1h-1050° C. | 321 | 321 | <0.1 | air |
| | HR-900°/1h-1050° C. | 429 | 471 | 1.2 | vacuum |
| | HR-900°/1h-1100° C. | 448 | 720 | 8.4 | oxygen |
| M4 | MR-900°/1h-800° C. | 335 | 590 | 6.4 | oxygen |
| | HR-900°/1h-900° C. | 400 | 424 | 1.2 | oxygen |
| | HR-900°/1h-1000° C. | 359 | 395 | 1.2 | air |
| | HR-900°/1h-1000° C. | 414 | 420 | 1.8 | oxygen |
| | HR-900°/1h-1100° C. | 383 | 539 | 3.9 | oxygen |
| M5 | HR-900°/1h-1000° C. | 340 | 364 | 0.8 | air |
| M6 | HR-900°/1h-1000° C. | 339 | 339 | <0.1 | air |
| M7 | HR-900°/1h-1000° C. | 325 | 342 | 2.0 | air |
| M8 | HR-900°/1h-1000° C. | 241 | 281 | 0.5 | air |
| M9 | HR-900°/1h-800° C. | 307 | 417 | 4.0 | oxygen |
| | HR-900°/1h-900° C. | 363 | 388 | 1.2 | oxygen |
| | HR-900°/1h-1000° C. | 221 | 221 | <0.1 | air |
| | HR-900°/1h-1000° C. | 342 | 342 | <0.1 | vacuum |
| | HR-900°/1h-1000° C. | 429 | 444 | 2.0 | oxygen |
| | HR-900°/1h-1100° C. | 246 | 246 | <0.1 | air |
| | HR-200°/1h-1100° C. | 380 | 560 | 5.1 | oxygen |
| M10 | HR-900°/1h-1000° C. | 349 | 358 | 0.6 | air |
| M11 | HR-900°/1h-1000° C. | 324 | 324 | <0.1 | air |

Figure 6:
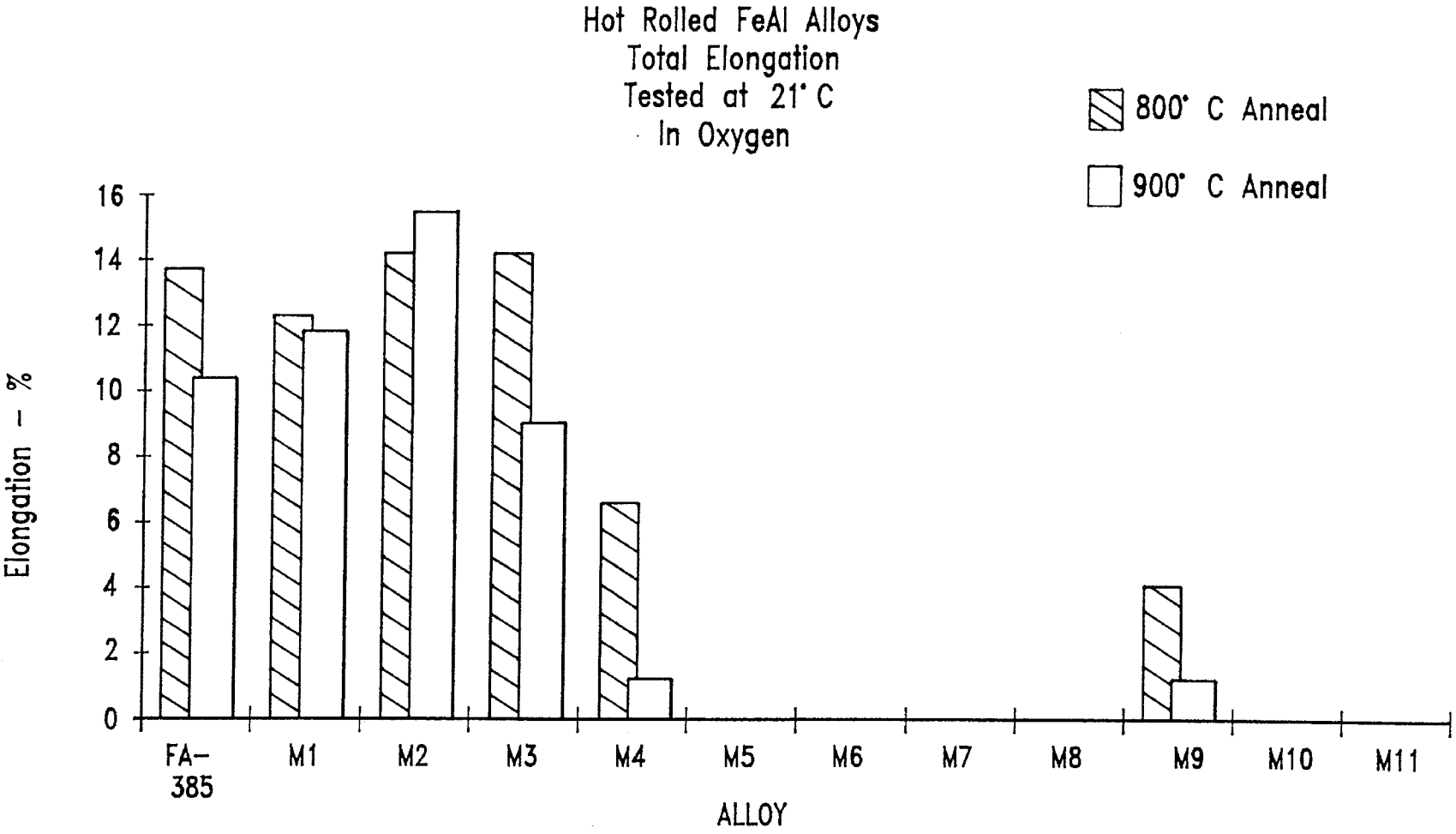
FIG. 6 is a graphical view illustrating the total elongation of several hot-rolled FeAl alloys tested at room temperature in oxygen with various anneal temperatures.
Figure 7:
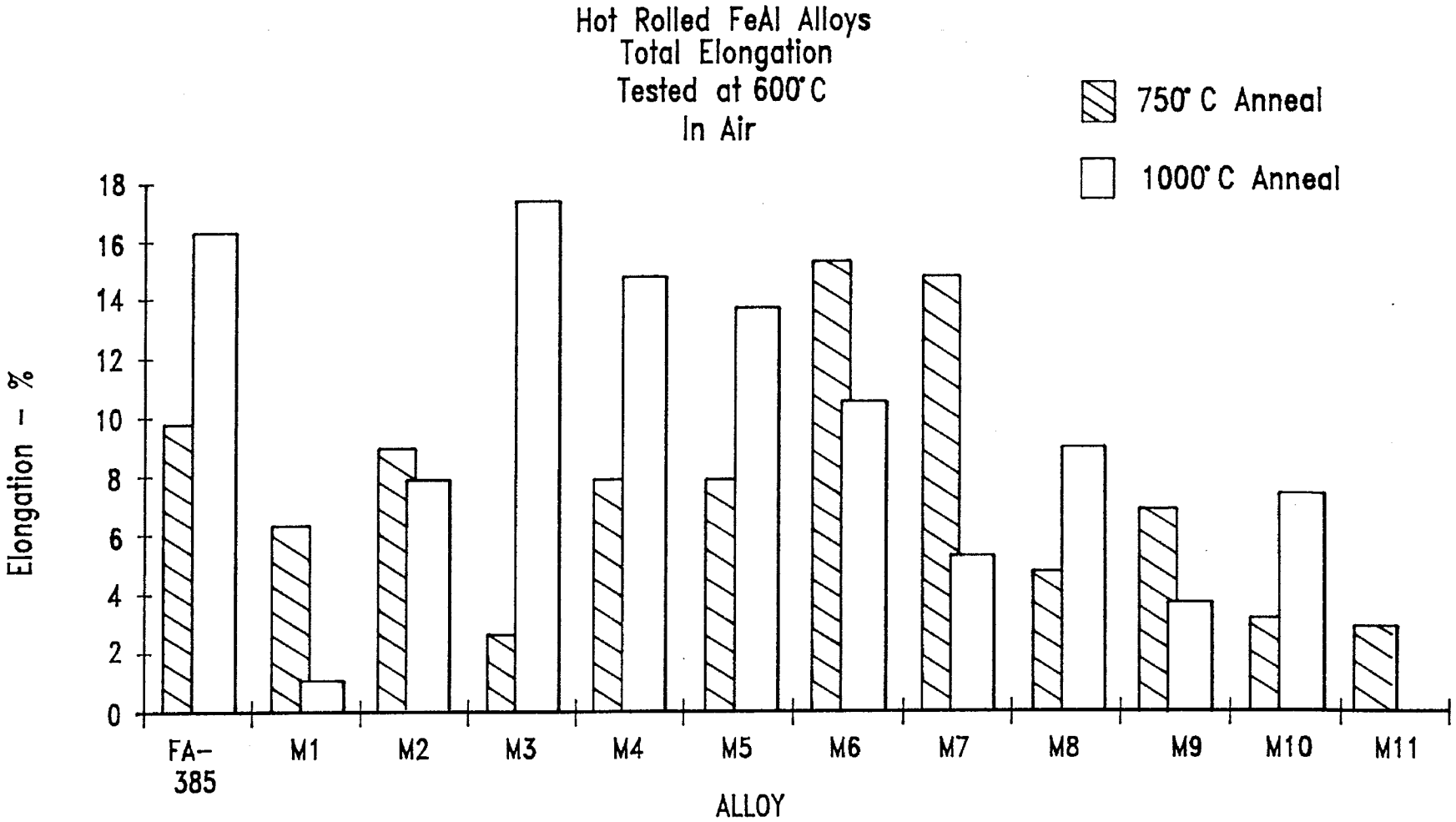
FIG. 7 is a graphical view illustrating the total elongation of several hot-rolled FeAl alloys tested at 600° C. in air with various anneal temperatures.

The total elongation of the hot-rolled alloys of this invention tested in air, as illustrated in FIG. 7 showed only fracture stresses with no measurable plastic deformation, and any alloying or heat-treatment effects appeared to be minimal. The same materials tested in oxygen at room temperature, as illustrated in FIG. 6 showed significantly more ductility, ranging generally from 10–15% total elongation, and the effects of alloy composition and heat-treatment. Tables 4, 4A and 4B clearly show that the FeAl alloys, FA-385, M1, M2, and M3 alloys, all had the highest levels of yield strength, ultimate tensile strength and total elongation, and all developed the best room temperature properties after a heat-treatment of one hour at 800° to 900° C. As illustrated in FIG. 4, the M1, M2 and M3 alloys appear to have yield strength of about 10 to about 20 percent higher than the base FA-385 alloy when annealed at 900° C.

Figure 3:
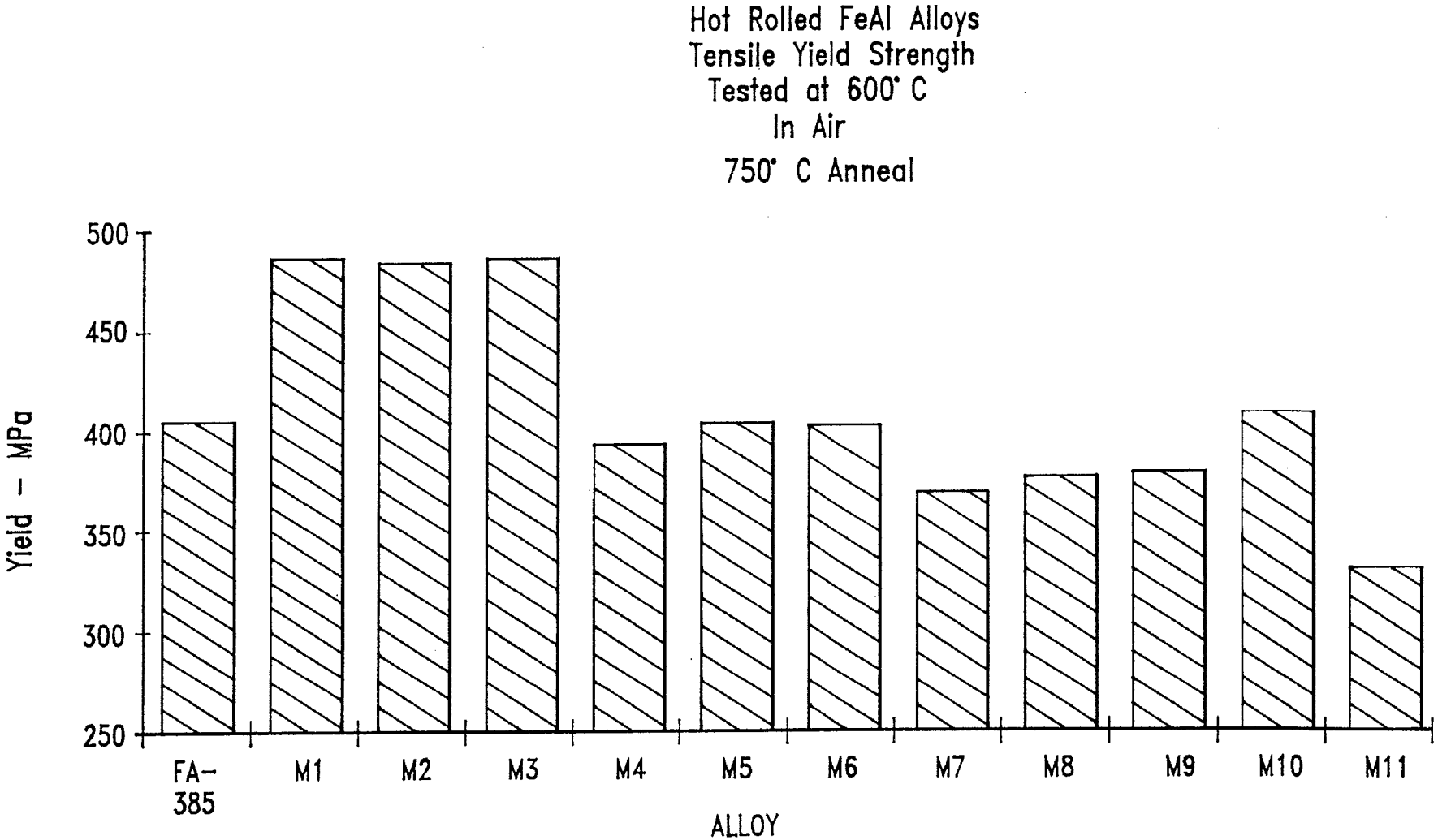
FIGS. 3 and 5 are graphical views illustrating the tensile yield strength of several hot-rolled FeAl alloys tested at 600° C. in air with various anneal temperatures.
Figure 5:
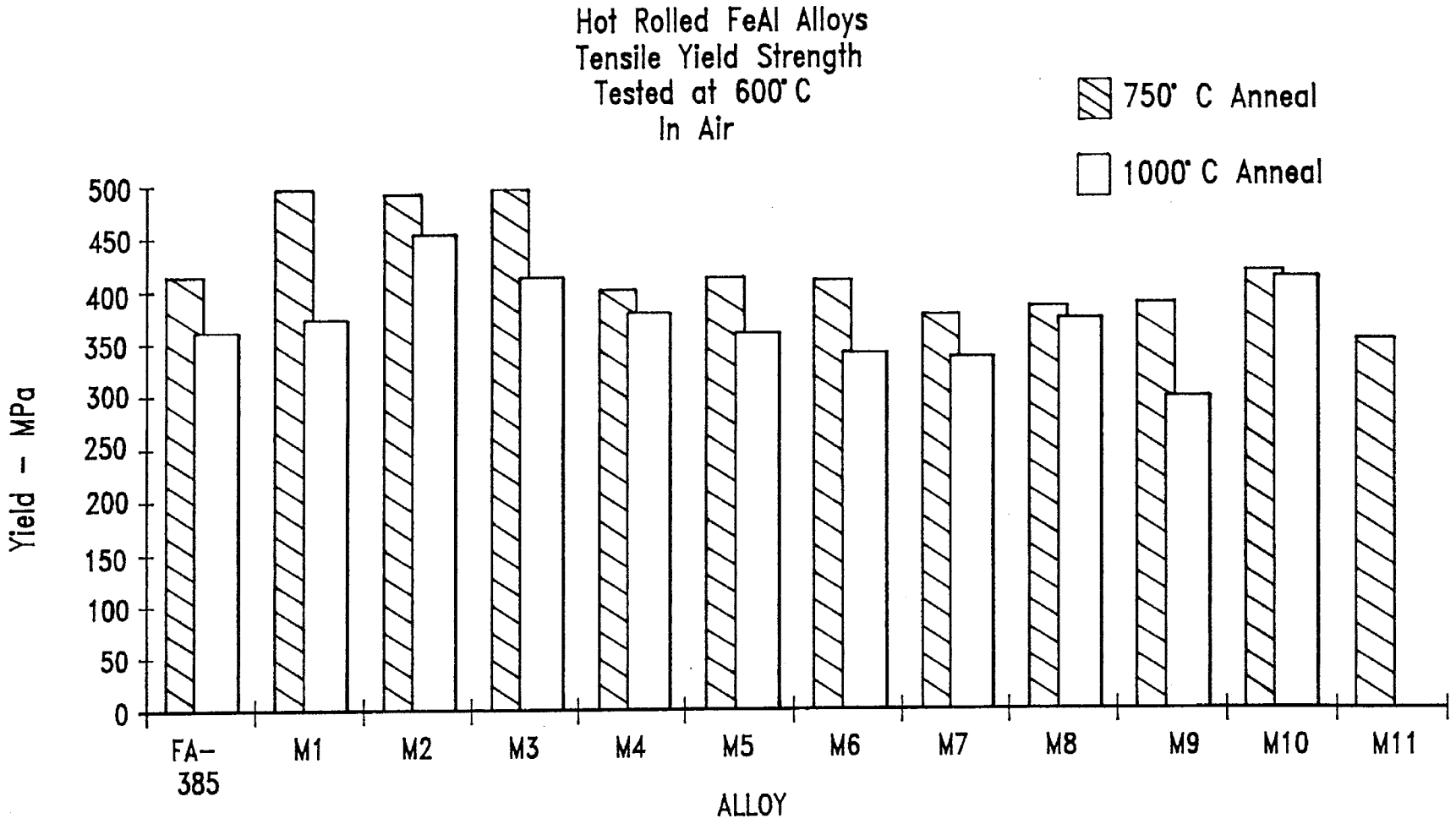

Tensile data for wrought FeAl alloys tested at a temperature of 600° C. is contained in Tables 4C and 4D and FIGS. 3 and 5.

TABLE 4C

Tensile Properties of FeAl Alloys at 600° C.

| Alloy | Fabrication Heat Treatment Conditions | 600 Degrees C. Yield (MPa) | Ultimate (MPa) | Elongation (%) |
|---|---|---|---|---|
| FA-324 | HR-900°/1h-750° C. | 312 | 353 | 49.3[1] |
| | 1h-800°/1h-700° C. | 332 | 394 | 20.1 |
| FA-350 | 1h-800°/1h-700° C. | 359 | 390 | 55.0[1] |
| | 1h-000°/1h-700° C. | 332 | 411 | 29.2 |
| FA-362 | 1h-800°/1h-700° C. | 424 | 453 | 34.3[1] |
| | 1h-800°/1h-700° C. | 420 | 531 | 25.1 |
| FA-372 | 1h-800°/1h-700° C. | 359 | 474 | 16.0 |
| FA-383 | 1h-800°/1h-700° C. | 334 | 470 | 11.4 |

TABLE 4C-continued

Tensile Properties of FeAl Alloys at 600° C.

| Alloy | Fabrication Heat Treatment Conditions | 600 Degrees C. Yield (MPa) | Ultimate (MPa) | Elongation (%) |
|---|---|---|---|---|
| FA-384 | 1h-800°/1h-700° C. | 308 | 440 | 14.3 |
| FA-385 | 1h-800°/1h-700° C. | 346 | 495 | 20.9 |
| | HR-900°/1h-750° C. | 400 | 493 | 11.0 |
| | HR-900°/1h-750° C. | 422 | 510 | 8.3 |
| | HR-900°/1h-750° C. | 389 | 481 | 10.1 |
| | extruded-900° C./1h-750° C. | 413 | 471 | 41.4 |
| | HR-900° C./1h-1000° C. | 357 | 451 | 14.6 |
| | HR-900° C./1h-1000° C. | 350 | 387 | 17.8 |
| FA-386 | 1h-800° C./1h-700° C. | 371 | 502 | 23.4 |
| FA-397 | 1h-800° C./1h-700° C. | 399 | 505 | 19.5 |
| FA-388 | 1h-800° C./1h-700° C. | 359 | 475 | 9.3 |
| | HR-900° C./1h-750° C. | 418 | 487 | 9.9 |
| | HR-900° C./1h-1000° C. | 357 | 453 | 9.9 |
| M1 | HR-900° C./1h-750° C. | 487 | 592 | 7.9 |
| | HR-900° C./1h-750° C. | 481 | 558 | 5.6 |
| | extruded-900° C./1h-750° C. | 437 | 518 | 40 |
| | HR-900° C./1h-1050° C. | 364 | 382 | 1.1 |

TABLE 4D

Tensile Properties of FeAl Alloys at 600° C.

| Alloy | Fabrication Heat Treatment Conditions | 600 Degrees C. Yield (MPa) | Ultimate (MPa) | Elongation (%) |
|---|---|---|---|---|
| M2 | HR-900° C./1 h-750° C. | 484 | 555 | 8.2 |
| | HR-900° C./1 h-750° C. | 480 | 567 | 9.6 |

TABLE 4D-continued

Tensile Properties of FeAl Alloys at 600° C.

| Alloy | Fabrication Heat Treatment Conditions | Yield (MPa) | 600 Degrees C. Ultimate (MPa) | Elongation (%) |
|---|---|---|---|---|
| | extruded-900° C./1 h-750° C. | 445 | 529 | 31.6 |
| | HR-900° C./1 h-1000° C. | 475 | 578 | 14.0 |
| | HR-900° C./1 h-1000° C. | 408 | 468 | 1.3 |
| M3 | HR-900°/1 h-750° C. | 478 | 542 | 2.1 |
| | HR-900° C./1 h-750° C. | 489 | 590 | 3.2 |
| | HR-900° C./1 h-1000° C. | 404 | 536 | 17.0 |
| | HR-900° C./1 h-1050° C. | 405 | 485 | 4.6 |
| M4 | HR-900°/1 h-750° C. | 390 | 482 | 9.1 |
| | HR-900°/1 h-750° C. | 395 | 503 | 6.9 |
| | HR-900°/1 h-1000° C. | 370 | 476 | 14.7 |
| M5 | HR-900°/1 h-750° C. | 416 | 521 | 11.4 |
| | HR-900°/1 h-750° C. | 389 | 487 | 4.4 |
| | HR-900° C./1 h-1000° C. | 351 | 466 | 13.6 |
| M6 | HR-900°/1 h-750° C. | 402 | 482 | 18.5 |
| | HR-900° C./1 h-750° C. | 401 | 477 | 12.2 |
| | HR-900° C./1 h-1000° C. | 333 | 449 | 10.7 |
| M7 | HR-900°/1 h-750° C. | 398 | 482 | 24.5 |
| | HR-900° C./1 h-750° C. | 335 | 482 | 4.5 |
| | HR-900° C./1 h-1000° C. | 328 | 461 | 5.4 |
| M8 | HR-900°/1 h-750° C. | 384 | 477 | 5.7 |
| | HR-900° C./1 h-750° C. | 369 | 473 | 4.1 |
| | HR-900° C./1 h-1000° C. | 365 | 475 | 9.1 |
| M9 | HR-900°/1 h-750° C. | 379 | 458 | 13.2 |
| | HR-900° C./1 h-750° C. | 375 | 405 | 0.9 |
| | HR-900° C./1 h-1000° C. | 289 | 369 | 3.7 |
| M10 | HR-900°/1 h-750° C. | 393 | 456 | 3.1 |
| | HR-900° C./1 h-750° C. | 420 | 521 | 3.3 |
| | HR-900° C./1 h-1000° C. | 397 | 535 | 7.5 |
| M11 | HR-900°/1 h-750° C. | 347 | 447 | 3.4 |
| | HR-900° C./1 h-750° C. | 313 | 315 | 2.5 |

As illustrated in Tables 4C and 4D and FIGS. 3 and 5, of the alloys of this invention tested at 600° C., alloys M1, M2 and M3 had about 20 percent higher yield strength as compared to the other alloys including the base alloy FA-385 and after a heat-treatment of one hour at 1000° to 1050° C., the M2 alloys appeared to have the highest yield strength.

Figure 9:
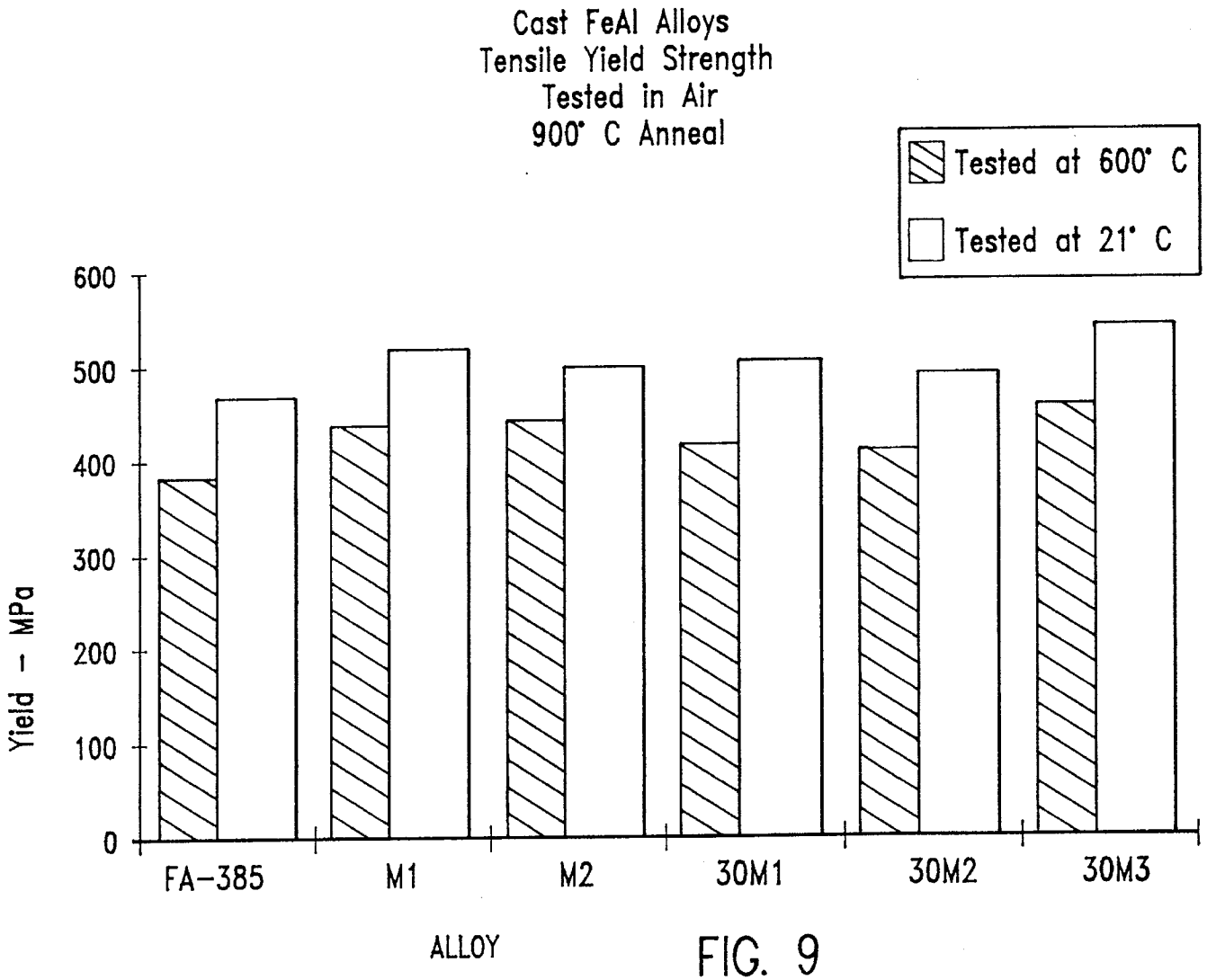
FIGS. 9, 10, and 11 are graphical views illustrating the tensile yield strength of several as-cast FeAl alloys.
Figure 10:
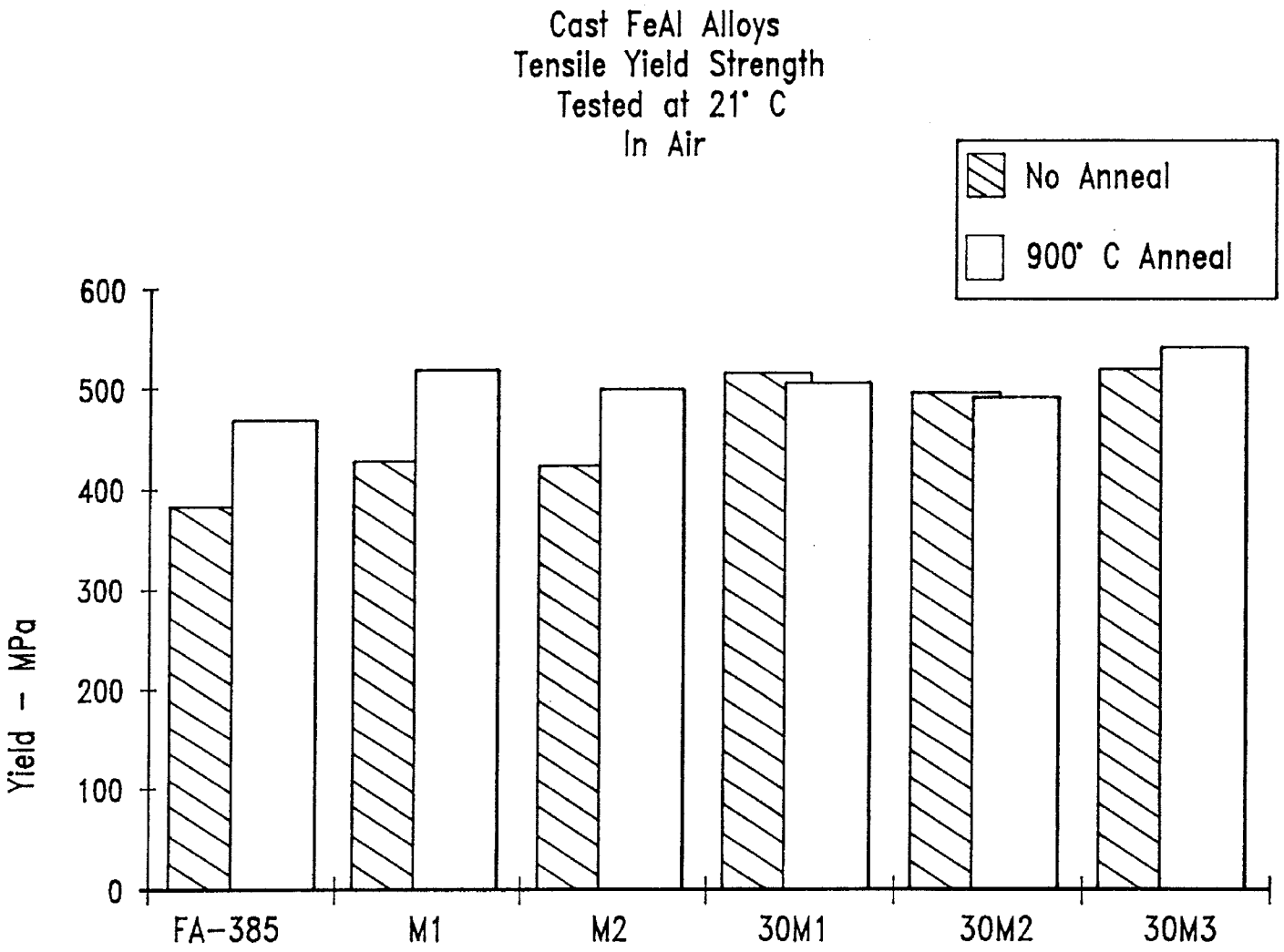

Room temperature tensile data for FeAl alloys extruded at 900° C. and in the as-cast condition are given separately in Table 4E and 4F. Table 4G and FIG. 11 contain the tensile data of cast FeAl alloys tested at 600° C. with and without heat treatment. FIG. 9 illustrates the tensile strengths of the as-cast alloys of this invention after a 900° C. heat treatment, tested at room temperature and at 600° C. FIG. 10 compares the tensile data of the as-cast alloys of this invention tested at room temperature with and without heat treatment.

TABLE 4E

Tensile Properties of Hot-Extruded FeAl Alloys at Room Temperature

| Alloy | Fabrication Heat Treatment Conditions | Room Temperature (22° C.) Yield (MPa) | Ultimate (MPa) | Elongation (%) | Test Environment |
|---|---|---|---|---|---|
| FA-385 | extruded-900° C./1 h-750° C. | 426 | 900 | 12.5 | oxygen |
| | extruded-900° C./1 h-750° C. | 412 | 759 | 8.4 | air |
| | extruded-900° C./1 h- | 505 | 636 | 4.4 | air |

TABLE 4E-continued

Tensile Properties of Hot-Extruded FeAl Alloys at Room Temperature

| Alloy | Fabrication Heat Treatment Conditions | Room Temperature (22° C.) Yield (MPa) | Ultimate (MPa) | Elongation (%) | Test Environment |
|---|---|---|---|---|---|
| | 1200° C. | | | | |
| M1 | extruded-900° C./1 h-750° C. | 439 | 974 | 13.9 | oxygen |
| | extruded-900° C./1 h-750° C. | 435 | 850 | 10.0 | air |
| | extruded-900° C./1 h-1200° C. | 502 | 656 | 4.5 | air |
| M2 | extruded-900° C./1 h-750° C. | 429 | 910 | 11.8 | oxygen |
| | extruded-900° C./1 h-750° C. | 436 | 861 | 10.2 | air |
| | extruded-900° C./1 h-1200° C. | 515 | 622 | 4.1 | air |

TABLE 4F

Tensile Properties of Cast FeAl Alloys at Room Temperature

| Alloy | Fabrication Heat Treatment Conditions | Room Temperature (22° C.) Yield (MPa) | Ultimate (MPa) | Elongation (%) | Test Environment |
|---|---|---|---|---|---|
| FA-385 | as cast | 383 | 494 | 2.15 | air |
| | as cast | 403 | 504 | 2.4 | air |
| | as cast | 434 | 688 | 6.8 | oxygen |
| | as cast/1 h-900° C. | 456 | 483 | 1.4 | air |
| | as cast/1 h-900° C. | 465 | 494 | 1.8 | air |
| | as cast/1 h-900° C. | 328 | 553 | 5.8 | oxygen |
| M1 | as cast | 422 | 509 | 2.29 | air |
| | as cast | 421 | 508 | 2.90 | air |
| | as cast | 453 | 527 | 2.5 | oxygen |
| | as cast/1 h-900° C. | 508 | 531 | 1.6 | air |
| | as cast/1 h-900° C. | 511 | 549 | 2.0 | air |
| | as cast/1 h-900° C. | 419 | 651 | 5.4 | oxygen |
| M2 | as cast | 420 | 514 | 2.5 | air |
| | as cast | 418 | 493 | 1.3 | air |
| | as cast | 449 | 507 | 2.0 | oxygen |
| | as cast/1 h-900° C. | 459 | 489 | 0.4 | air |
| | as cast/1 h-900° C. | 518 | 550 | 1.8 | air |
| FA-30M1 | as cast | 511 | 580 | 1.6 | air |
| | as cast | 516 | 594 | 1.3 | air |
| | as cast | 539 | 608 | 1.6 | oxygen |
| | as cast/1 h-900° C. | 491 | 558 | 0.9 | air |
| | as cast/1 h-900° C. | 507 | 551 | 0.9 | air |
| | as cast/1 h-900° C. | 453 | 638 | 3.8 | oxygen |
| FA-30M2 | as cast | 487 | 550 | 1.0 | air |
| | as cast | 482 | 551 | 1.1 | air |
| | as cast | 508 | 508 | 1.1 | oxygen |
| | as cast/1 h- | 475 | 534 | 0.7 | air |

TABLE 4F-continued

Tensile Properties of Cast FeAl Alloys at Room Temperature

| Alloy | Fabrication Heat Treatment Conditions | Room Temperature (22° C.) Yield (MPa) | Ultimate (MPa) | Elongation (%) | Test Environment |
|---|---|---|---|---|---|
| | 900° C. as cast/1 h-900° C. | 486 | 528 | 1.8 | air |
| FA-30M3 | as cast | 509 | 588 | 1.3 | air |
| | as cast | 512 | 587 | 1.2 | air |
| | as cast | 527 | 606 | 1.8 | oxygen |
| | as cast/1 h-900° C. | 533 | 569 | 2.7 | air |
| | as cast/1 h-900° C. | 528 | 567 | 1.2 | air |
| | as cast/1 h-900° C. | 500 | 727 | 6.0 | oxygen |

TABLE 4G

Tensile Properties of Cast FeAl Alloys at 600° C.

| Alloy | Fabrication Heat Treatment Conditions | Room Temperature (22° C.) Yield (MPa) | Ultimate (MPa) | Elongation (%) | Test Environment |
|---|---|---|---|---|---|
| FA-385 | as cast | 380 | 471 | 29.6 | air |
| | as cast/1 h-900° C. | 383 | 473 | 26.9 | air |
| | as cast/1 h-1200° C. | 392 | 469 | 22.7 | air |
| M1 | as cast | 416 | 531 | 22.2 | air |
| | as cast/1 h-900° C. | 431 | 521 | 22.5 | air |
| | as cast/1 h-1200° C. | 433 | 531 | 22.0 | air |
| M2 | as cast | 420 | 530 | 23.2 | air |
| | as cast/1 h-900° C. | 434 | 537 | 21.6 | air |
| FA-30M1 | as cast | 438 | 506 | 23.9 | air |
| | as cast/1 h-900° C. | 409 | 537 | 26.3 | air |
| | as cast/1 h-1200° C. | 463 | 560 | 14.8 | air |
| FA-30M2 | as cast | 419 | 520 | 10.3 | air |
| | as cast/1 h-900° C. | 402 | 461 | 22.8 | air |
| | as cast/1 h-1200° C. | 462 | 513 | 10.7 | air |
| FA-30M3 | as cast | 446 | 576 | 19.3 | air |
| | as cast/1 h-900° C. | 448 | 502 | 29.9 | air |
| | as cast/1 h-1200° C. | 461 | 545 | 22.4 | air |

Figure 11:
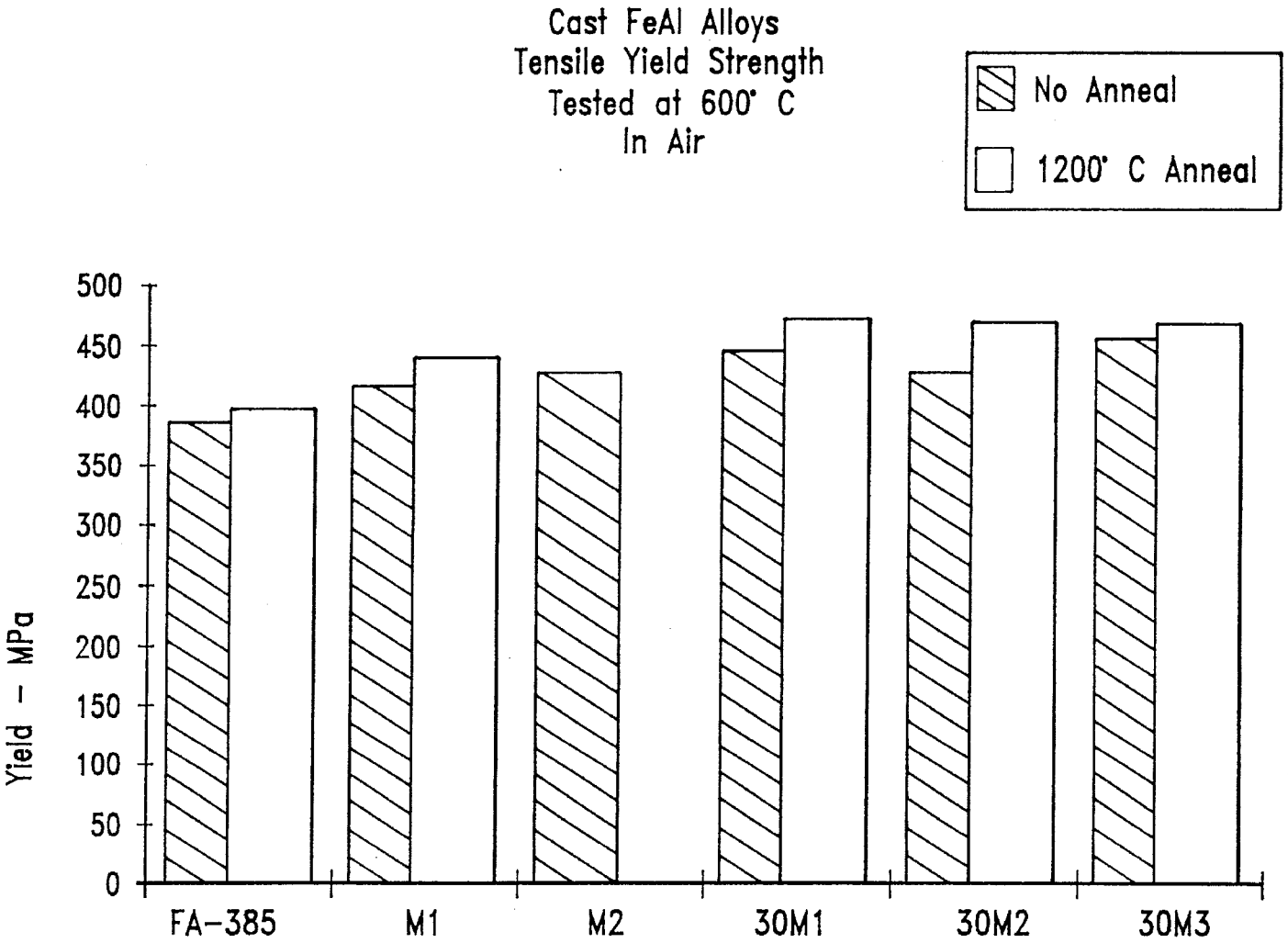
Figure 12:
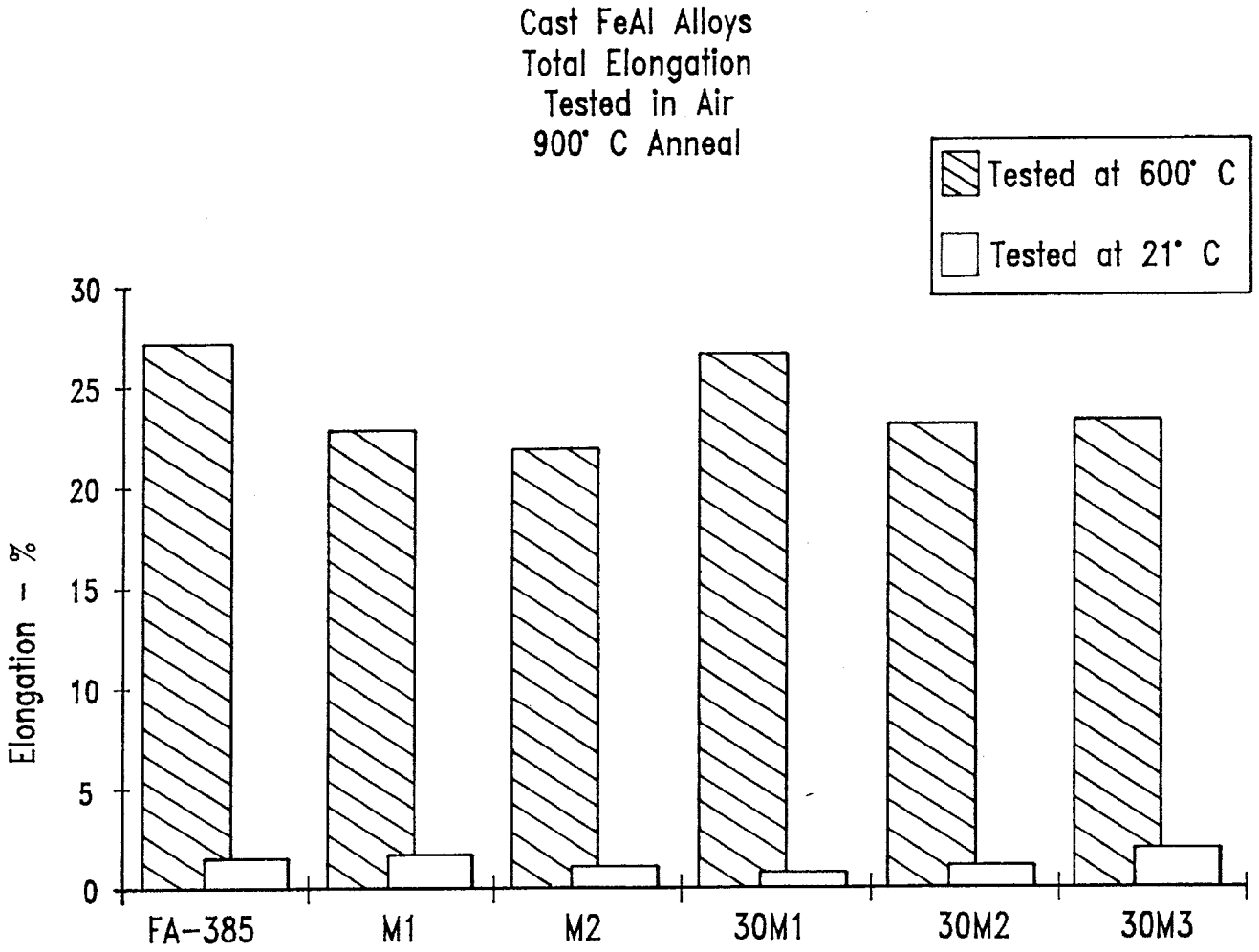
FIG. 12 is a graphical view illustrating the total elongation of several as-cast FeAl alloys.

The most significant, unexpected discovery in the tensile properties of the FeAl alloys of this invention is the room temperature and high temperature yield strengths for the alloys in the as-cast condition as illustrated in Tables 4F and 4G and FIGS. 9–11. Even though the as-cast materials have a significantly coarser grain size (250–667 μm as compared to 24–41 μm for fine-grained microstructures formed by extrusion), these alloys possess only about a 2 to 3 percent total elongation in air and yield strength values that are the same or slightly better than the fine-grained as-extruded material. Furthermore, the as-cast M1 and M2 alloys appear to retain the same strength at room temperature up to at least 600° C., while the ductility increases significantly (up to about 22 percent total elongation) when tested at 600° C. as illustrated in FIG. 12.

It was found previously that fine-grained microstructures (24–41 μm) produced by hot-rolling, extrusion or forging, such as FeAl alloy FA-350 containing 0.05% Zr and 0.24% B, provided the optimum room temperature ductility in air of 9–10%. Similar extrusions at 900° C. also produced fine-grained microstructures (20–75 μm) in the FA-385, M1 and M2 alloys. The M1 and M2 alloys with optimum weldability also exhibit similar room temperature ductility (about 10%) after similar processing as compared to the FA-350 alloy. Furthermore, the M1 and M2 alloys have about a 34% tensile strength advantage over the FA-350 alloy, even though the fine-grained, extruded materials have a slightly lower high temperature tensile strength as compared to coarser grained (200–300% coarser grain size) heat-treated material.

Figure 8:
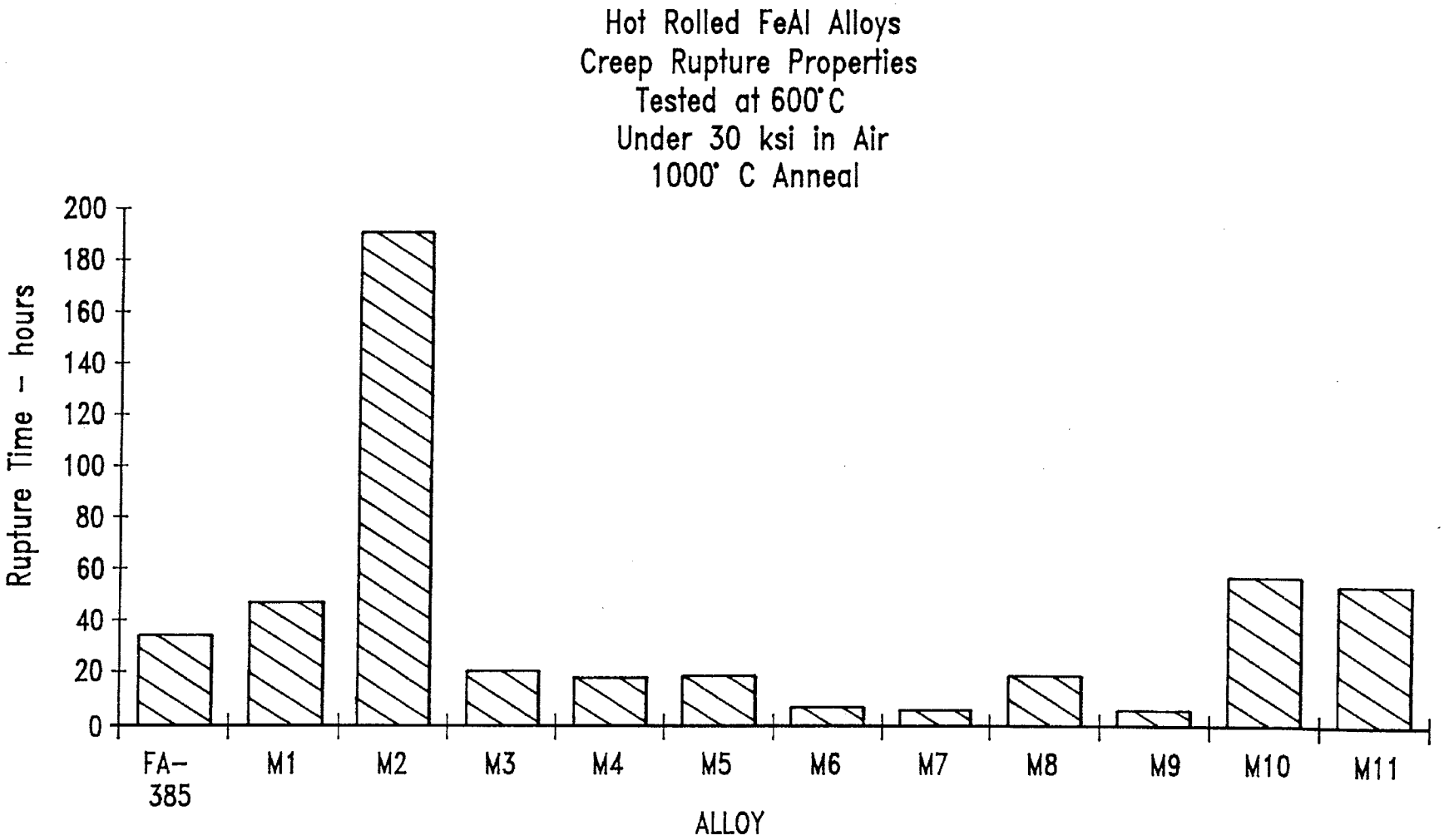
FIG. 8 is a graphical representation of the creep rupture properties versus time of several hot-rolled FeAl alloys.

Tables 5, 5A, and 5B and FIG. 8 contain the creep and rupture data for wrought FeAl alloys (hot-rolled or extruded at 900° C.) tested at 600° C. and 30 ksi (207 MPa). Table 5C contains the creep and rupture data for as-cast FeAl alloys tested at 600° C.

TABLE 5

Creep-Rupture Properties of FeAl Alloys

| Alloy | Heat Treatment Conditions | Creep Conditions Temp. (°C.) | Stress (ksi) | Rupture Time (hr) | Elongation (%) | Minimum Creep-rate (%/h) |
|---|---|---|---|---|---|---|
| FA-324 | HR 800° C./1 h-700° C. | 593 | 20 | 46.4 | 28.0 | 0.23 |
| FA-350 | HR-800° C./1 h-700° C. | 593 | 20 | 106.6 | 123.2 | 0.22 |
| FA-362 | HR-600° C./1 h-700° C. | 593 | 20 | 865.4 | 87.7 | 0.04 |
| | HR-800° C./1 h-700° C. | 593 | 20 | 932.2 | 74.3 | 0.03 |
| | HR-1000° C./2 h-700° C. | 593 | 20 | 278.6 | 74.3 | 0.09 |
| FA-365 | HR-800° C./1 h-700° C. | 593 | 20 | 129.0 | 25.9 | 0.16 |
| | HR-900° C./1 h-750° C. | 600 | 30 | 11.0 | 62.8 | 1.70 |
| | HR-900° C./1 h-750° C. | 600 | 30 | 10.3 | 56.3 | 3.10 |
| | HR-900° C./1 h-1000° C. | 600 | 30 | 8.8 | 38.0 | 3.00 |
| | HR-900° C./1 h-1000° C. | 600 | 30 | 60.0 | 40.0 | — |
| | HR-900° C./1 h-1050° C. | 600 | 30 | 5.5 | 30.0 | 2.70 |
| | HR- | 600 | 30 | 3.5 | 45.0 | 5.70 |

TABLE 5-continued

Creep-Rupture Properties of FeAl Alloys

| Alloy | Heat Treatment Conditions | Creep Conditions Temp. (°C.) | Creep Conditions Stress (ksi) | Rupture Time (hr) | Rupture Elongation (%) | Minimum Creep-rate (%/h) |
|---|---|---|---|---|---|---|
| FA-388 | 900° C./ 1 h- 1150° C. HR- 900° C./ 1 h- 1200° C. | 600 | 30 | 4.0 | 29.0 | 4.20 |
| | extruded at 900° C. | 600 | 30 | 5.75 | 90.0 | — |
| | extruded at 900° C./ 1 h- 1200° C. | 600 | 30 | 12.6 | 62.6 | 1.80 |
| | HR- 900° C./ 1 h- 750° C. | 600 | 30 | 7.8 | 47.5 | 3.70 |
| | HR- 900° C./ 1 h- 750° C./ 1 hr- 1000° C. | 600 | 30 | 6.5 | 40.5 | 3.80 |
| | HR- 900° C./ 1 h- 1000° C. | 600 | 30 | 7.8 | 47.5 | 3.70 |
| | HR- 900° C./ 1 h- 1000° C. | 600 | 30 | 6.5 | 40.5 | 3.80 |
| | HR- 900° C./ 1 h- 1000° C. | 600 | 30 | 4.4 | 9.2 | 2.25 |

TABLE 5A

Creep-Rupture Properties of FeAl Alloys

| Alloy | Heat Treatment Conditions | Creep Conditions Temp. (°C.) | Creep Conditions Stress (ksi) | Rupture Time (hr) | Rupture Elongation (%) | Minimum Creep-rate (%/h) |
|---|---|---|---|---|---|---|
| M1 | HR-900°/ 1 h- 750° C. | 600 | 30 | 295.7 | 15.7 | 0.02 |
| | HR-900°/ 1 h- 750° C. | 600 | 30 | 434.0 | 14.5 | 0.01 |
| | HR-900°/ 1 h- 1000° C. | 600 | 30 | 48.0 | 37.0 | — |
| | HR-900°/ 1 h- 1050° C. | 600 | 30 | 138.7 | 33.0 | 0.10 |
| | HR-900°/ 1 h- 1200° C. | 600 | 30 | 84.4 | 30.3 | — |
| | extruded at 900° C. | 600 | 30 | 61.9 | 77.0 | — |
| | extruded | 600 | 30 | 36.2 | 0.25 | 0.0062 |

TABLE 5A-continued

Creep-Rupture Properties of FeAl Alloys

| Alloy | Heat Treatment Conditions | Creep Conditions Temp. (°C.) | Creep Conditions Stress (ksi) | Rupture Time (hr) | Rupture Elongation (%) | Minimum Creep-rate (%/h) |
|---|---|---|---|---|---|---|
| M2 | at 900° C./ 1 h- 1200° C. HR- 900° C./ 1 h- 750° C. | 600 | 30 | 271.0 | 9.5 | 0.015 |
| | HR- 900° C./ 1 h- 750° C. | 600 | 30 | 267.0 | 16.3 | 0.015 |
| | HR-900°/ 1 h- 1000° C. | 600 | 30 | 216.2 | 43.0 | 0.15 |
| | HR-900°/ 1 h- 1000° C. | 600 | 30 | 165.0 | 45.0 | 0.20 |
| | HR-900°/ 1 h- 1050° C. | 600 | 30 | 184.0 | 35.3 | 0.13 |
| | extruded at 900° C. | 600 | 30 | 65.0 | — | — |
| M3 | HR- 900° C./ 1 h- 750° C. | 600 | 30 | 20.1 | 56.4 | 0.90 |
| | HR- 900° C./ 1 h- 1000° C. | 600 | 30 | 21.6 | 43.6 | 0.08 |
| | HR- 900° C./ 1 h- 1150° C. | 600 | 30 | 14.3 | 30.2 | 0.74 |
| | HR- 900° C./ 1 h- 1200° C. | 600 | 30 | 15.9 | 43.8 | 0.80 |
| M4 | HR- 900° C./ 1 h- 750° C. | 600 | 30 | 11.2 | 24.3 | 2.20 |
| | HR- 900° C./ 1 h- 750° C. | 600 | 30 | 16.0 | 32.5 | 1.40 |
| | HR- 900° C./ 1 h- 1000° C. | 600 | 30 | 17.8 | 20.1 | 0.70 |
| | HR- 900° C./ 1 h- 1150° C. | 600 | 30 | 17.6 | 28.1 | 0.60 |
| M5 | HR- 900° C./ 1 h- 750° C. | 600 | 30 | 12.3 | 33.0 | 1.00 |
| | HR- 900° C./ 1 h- 750° C. | 600 | 30 | 26.3 | 32.4 | 0.60 |
| | HR- 900° C./ 1 h- 1000° C. | 600 | 30 | 19.2 | 27.6 | 2.20 |

TABLE 5B

| Alloy | Heat Treatment Conditions | Creep Conditions Temp. (°C.) | Creep Conditions Stress (ksi) | Rupture Time (hr) | Rupture Elongation (%) | Minimum Creep-rate (%/h) |
|---|---|---|---|---|---|---|
| M6 | HR-900° C./1 h-750° C. | 600 | 30 | 11.4 | 33.5 | 1.90 |
| | HR-900° C./1 h-750° C. | 600 | 30 | 13.1 | 38.8 | 1.60 |
| | HR-900° C./1 h-1000° C. | 600 | 30 | 8.0 | 36.0 | 2.30 |
| M7 | HR-900° C./1 h-750° C. | 600 | 30 | 14.6 | 47.0 | 1.90 |
| | HR-900° C./1 h-750° C. | 600 | 30 | 8.0 | 29.0 | 2.30 |
| | HR-900° C./1 h-1000° C. | 600 | 30 | 7.0 | 23.0 | 1.90 |
| M8 | HR-900° C./1 h-750° C. | 600 | 30 | 15.9 | 29.0 | 1.10 |
| | HR-900° C./1 h-750° C. | 600 | 30 | 5.0 | 12.3 | 1.30 |
| | HR-900° C./1 h-1000° C. | 600 | 30 | 20.3 | 23.0 | 0.55 |
| M9 | HR-900° C./1 h-750° C. | 600 | 30 | 8.1 | 38.1 | 2.80 |
| | HR-900° C./1 h-1000° C. | 600 | 30 | 5.8 | 35.7 | 1.80 |
| | HR-900° C./1 h-1150° C. | 600 | 30 | 7.7 | 22.9 | 1.60 |
| | HR-900° C./1 h-1200° C. | 600 | 30 | 7.0 | 25.3 | 1.90 |
| M10 | HR-900° C./1 h-750° C. | 600 | 30 | 24.4 | 35.0 | 0.80 |
| | HR-900° C./1 h-1000° C. | 600 | 30 | 58.6 | 27.6 | 0.20 |
| M11 | HR-900° C./1 h-750° C. | 600 | 30 | 7.9 | 21.4 | 1.60 |
| | HR-900° C./1 h-1000° C. | 600 | 30 | 56.0 | 20.0 | 0.20 |

As illustrated in Tables 5, 5A and 5B, the M1 and M2 alloys exhibited outstanding creep-rupture lifetimes at 600° C. under 207 MPa stress. After heat treatments of one hour at 1000° to 1050° C., the M2 alloy appeared to retain more strength than any of the other alloys as illustrated in FIG. 8.

The creep and rupture properties of the as-cast alloys were also compared. The results are contained in Table 5C and illustrated in FIG. 13.

TABLE 5C

| Alloy | Heat Treatment Conditions | Creep Conditions Temp. (°C.) | Creep Conditions Stress (ksi) | Rupture Time (hr) | Rupture Elongation (%) | Minimum Creep-rate (%/h) |
|---|---|---|---|---|---|---|
| FA-385 | as cast | 600 | 30 | 12.0 | 70.0 | — |
| | as cast/1 h-900° C. | 600 | 30 | 11.0 | 64.4 | — |
| | as cast/1 h-1200° C. | 600 | 30 | 31.2 | 84.4 | 0.67 |
| | as cast/1 h-1250° C. | 600 | 30 | 12.0 | 72.5 | 1.63 |
| M1 | as cast | 600 | 30 | 454 | 47.5 | — |
| | as cast/1 h-900° C. | 600 | 30 | 380 | 28.0 | — |
| | as cast/1 h-1200° C. | 600 | 30 | 431 | 52.0 | 0.056 |
| | as cast/1 h-1250° C. | 600 | 30 | 404 | 45.0 | 0.071 |
| M2 | as cast | 600 | 30 | 674 | 44.2 | 0.0025 |
| | as cast/1 h-900° C. | 600 | 30 | 642 | 51.0 | 0.00124 |
| | as cast/1 h-1200° C. | 600 | 30 | 388 | 46.6 | 0.062 |
| | as cast/1 h-1250° C. | 600 | 30 | 520 | 48.4 | 0.04 |
| FA-30M1 | as cast | 600 | 30 | 96.3 | 40.0 | — |
| FA-30M2 | as cast | 600 | 30 | 53.6 | 37.6 | — |
| FA-30M3 | as cast | 600 | 30 | 160 | 30.0 | — |
| | as cast/1 h-900° C. | 600 | 30 | 121.4 | 62.0 | — |

Figure 13:
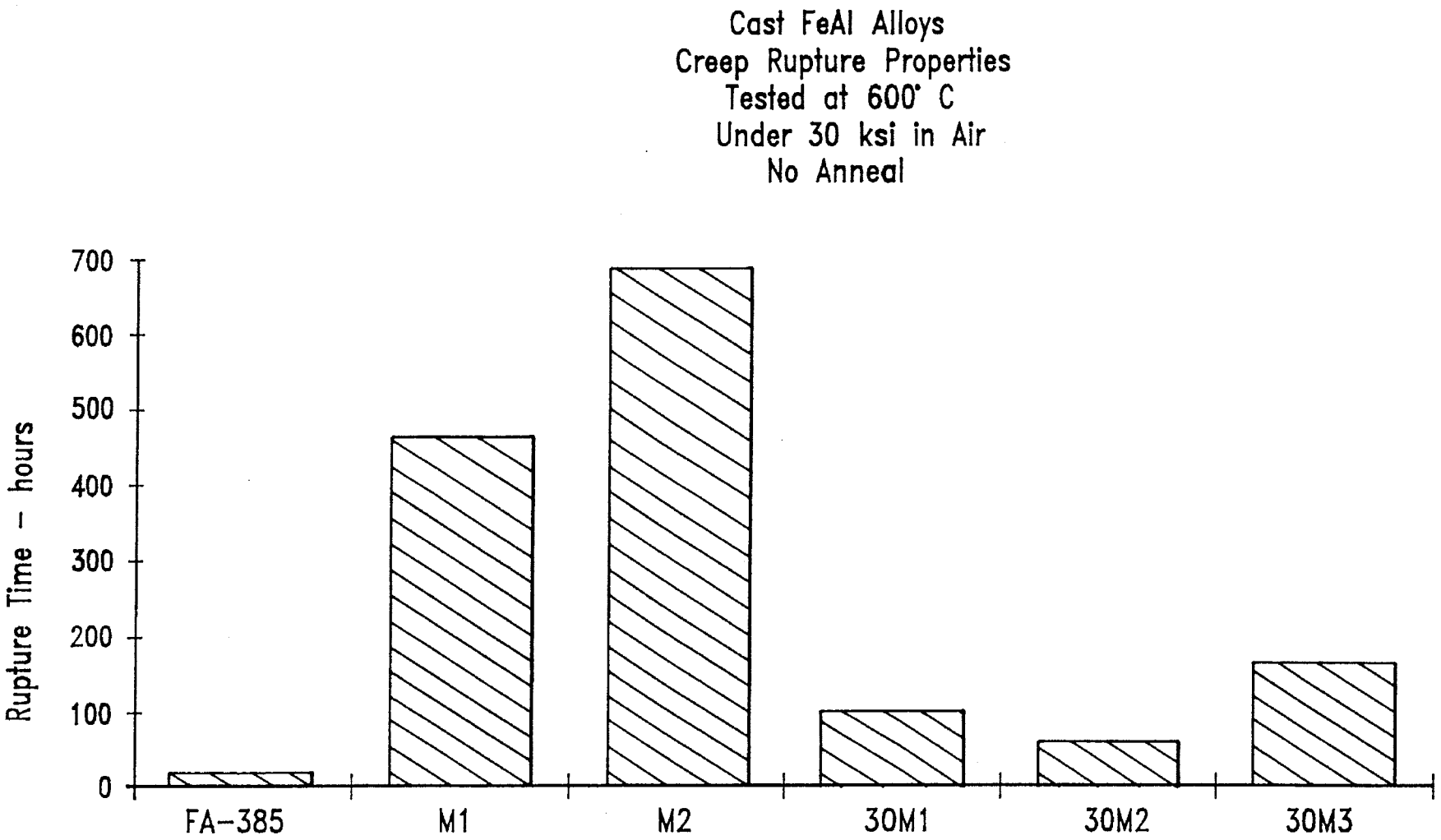
FIG. 13 is a graphical representation of the creep rupture properties versus time of several as-cast FeAl alloys.

As illustrated in Table 5C, the as-cast M1 and M2 alloys having significantly coarser grain-size (250 to 667 μm) show exceptional creep and rupture resistance when tested at 600° C. under 207 MPa (30 ksi) stress, with rupture lives ranging from 380 to almost 700 hours. These alloys also exhibit high values for creep-ductility as illustrated by FIG. 13. Furthermore, the M2 alloy appears to have the best rupture lifetime with the lowest minimum creep-rate.

Based on the foregoing and on the preferred practice described in U.S. Pat. No. 5,320,802 for FeAl alloys, alloys like FA-362 and FA-372 which exhibited the best high-temperature strength and room-temperature ductility (Tables 4C and 5) were unweldable or had marginal weldability that was clearly inferior to that demonstrated by the alloy compositions of this present invention (Table 3). High-temperature (600° C.) tensile and creep testing of alloys prepared according to this invention demonstrate that high-temperature strength is no worse than the FA-385 or FA-388 base alloy compositions, and in many cases is better as illustrated in Tables 4C, 4D, 5 and 5A.

For structural applications, the alloys that are the subject of the present invention can be prepared and processed to final form by known methods similar to those methods that were applicable to the base alloys disclosed in U.S. Pat. No. 5,320,802 incorporated herein by reference as if fully set forth. Accordingly, the FeAl iron aluminides of this invention may be prepared and processed to final form by any of the know methods such as arc or air-induction melting, for example, followed by electroslag remelting to further refine the ingot surface quality and grain structure as the as-cast condition. The ingots may then be processed by hot forging, hot extrusion, and hot rolling together with heat treatment.

To test the potential of the FeAl alloys of this invention for nonstructural use as weld-overlay cladding on conventional commercial structural steels and alloys, weld deposits (employing the gas-tungsten-arc (GTA) welding process) using the FeAl alloys of this invention have been made on type 304 L austenitic stainless and 2¼ Cr-1Mo bainitic steel substrates. While these weldable FeAl alloys exhibited no apparent hot-cracking failures during welding, the weld-deposit pads were found to have cracks due to a delayed cold-cracking mechanism that occurred during cooling after the welding was complete. Such cold-cracking behavior may be due to several different causes, but a major cause is believed to be hydrogen embrittlement. Consistently, when several special welding methods are combined with the alloys of the present invention, crack-free FeAl weld deposits can be obtained. One special welding method was found to be a preheat of 200° C. and a post-weld heat-treatment of 400° C., for FeAl alloy single layer deposits on thinner (about 12.5 mm thick) steel substrates. For multilayer weld-overlay deposits of FeAl alloys of the present invention on thicker steel substrates (about 25.4 mm thick), a preheat of 200° C., interpass temperatures of not below 350° C. and post-weld heat-treatments of up to 800° C. were found to produce crack-free cladding.

It is known in principle and has been found experimentally that FeAl alloys used as weld-consumables for either filler-metal or weld-overlay cladding applications will experience some changes in composition caused by the welding process. These compositional changes can include aluminum loss (the melting point of elemental aluminum is much lower than that of elemental iron) for both applications, or aluminum loss and pick-up of other elements from the different base-metal substrate due to dilution of the weld-metal by the base-metal. Therefore, for nonstructural applications of the alloys that are the subject of this invention, commercially produced FeAl weld-consumables may need to have somewhat different compositions (e.g., more aluminum, more or less carbon, more or less boron, etc.) prior to welding than the target FeAl invention alloy compositions for the desired application (e.g. cladding) produced through the welding process. Tables 6 and 7 illustrate preferred weld-consumable compositions which are the subject of this invention.

TABLE 6

FeAl Iron-Aluminide Weld Rods Containing 31–32% Al (Wt. %)

| Weld Rod Alloys | Zr | Mo | B | C | Cr | Nb | Ti |
|---|---|---|---|---|---|---|---|
| 1 | 0.2 | 0.3 | — | 0.1 | 3–4 | 0.5 | 0.6 |
| 2 | 0.2 | 0.3 | 0.0025 | 0.1 | 3–4 | 0.5 | 0.6 |
| 3 | 0.2 | 0.3 | 0.005 | 0.1 | 3–4 | 0.5 | 0.6 |

TABLE 7

FeAl Iron-Aluminide Weld Rods Containing 48–49% Al (At. %)

| Weld Rod Alloys | Zr | Mo | B | C | Cr | Nb | Ti |
|---|---|---|---|---|---|---|---|
| 1 | 0.1 | 0.13 | — | 0.3 | 3–4 | 0.2 | 0.5 |
| 2 | 0.1 | 0.13 | 0.008 | 0.3 | 3–4 | 0.2 | 0.5 |
| 3 | 0.1 | 0.13 | 0.017 | 0.3 | 3–4 | 0.2 | 0.5 |

Since weldability is mainly an inherent characteristic of an FeAl alloy produced within a certain alloy composition range, the invention FeAl alloy is not limited to any particular method for production of weld-consumables, and any appropriate method for producing such weld-consumables is applicable here.

From the foregoing, it must be appreciated that the invention provides FeAl iron-aluminides that exhibit superior weldability without impairing the outstanding high-temperature corrosion resistance and the mechanical properties critical to the usefulness of such alloys in structural applications. The improved alloys based on the FeAl phase employ readily available alloying elements which are relatively inexpensive so that the resulting compositions are subject to a wide range of economical uses. Furthermore, iron and aluminum are not considered toxic metals (EPA-RCRA regulations) as are nickel and chromium, which are major constituents of most heat-resistant and/or corrosion-resistant alloys. Therefore, there is also an environmental/waste-disposal benefit to the increased use of the FeAl alloys disclosed and claimed herein.

Although various compositions in accordance with the present invention have been set forth, in the foregoing detailed description, it will be understood that these are for purposes of illustration only and not intended as a limitation of scope of the appended claims, including all permissible equivalents.

What is claimed:

1. A corrosion resistant intermetallic alloy comprising, in atomic percent, an FeAl iron aluminide containing more than about 30% up to about 40% aluminum alloyed with from about 0.1% to about 0.5% carbon, from about 0.01% to about 3.5% of one or more transition metals selected from Group IVB, VB, and VIB elements and the balance iron, wherein the alloy exhibits improved resistance to hot cracking.

2. The corrosion resistant intermetallic alloy of claim 1 further comprising boron wherein the atomic weight ratio of boron to carbon in the alloy is in the range of from about 0.01:1 to about 0.08:1, and wherein the amount of boron in the alloy is no more than about 0.04%.

3. The corrosion resistant intermetallic alloy of claim 1 wherein the transition metal is selected from chromium, molybdenum, niobium, titanium, tungsten, and zirconium.

4. The corrosion resistant intermetallic alloy of claim 3 containing from about 0.1% to about 0.3% molybdenum and from about 0.01% to about 0.15% zirconium.

5. The corrosion resistant intermetallic alloy of claim 2 containing from about 0.1% to about 0.3% molybdenum and from about 0.01% to about 0.15% zirconium.

6. A weldable intermetallic alloy comprising, in atomic percent, an FeAl iron aluminide containing more than about 30% up to about 40% aluminum alloyed with a synergistic combination of carbon and chromium wherein the carbon content is in the range of from about 0.1% to about 0.5% and the chromium content is up to about 3% and the balance being iron.

7. The weldable intermetallic alloy of claim 6 further comprising boron wherein the atomic weight ratio of boron to carbon in the alloy is in the range of from about 0.01:1 to about 0.08:1, and wherein the amount of boron in the alloy is no more than about 0.04%.

8. The weldable intermetallic alloy of claim 7 further comprising one or more transition metals selected from molybdenum, titanium, tungsten, and zirconium.

9. The weldable intermetallic alloy of claim 6 further comprising one or more transition metals selected from molybdenum, titanium, tungsten, and zirconium.

10. The weldable intermetallic alloy of claim 8 containing from about 0.1% to about 0.3% molybdenum and from about 0.01% to about 0.15% zirconium.

11. The weldable intermetallic alloy of claim 7 containing from about 0.1% to about 0.3% molybdenum and from about 0.01% to about 0.15% zirconium.

12. A weldable intermetallic alloy comprising in atomic percent, an FeAl iron aluminide containing more than about 30% up to about 40% aluminum alloyed with a synergistic combination of carbon and niobium wherein the carbon content is in the range of from about 0.1% to about 0.5% and the niobium content is up to about 2% and the balance being iron.

13. The weldable intermetallic alloy of claim 12 further comprising boron wherein the atomic weight ratio of boron to carbon in the alloy is in the range of from about 0.01:1 to about 0.08:1, and wherein the amount of boron in the alloy is no more than about 0.04%.

14. The weldable intermetallic alloy of claim 13 further comprising one or more transition metals selected from molybdenum, titanium, tungsten, and zirconium.

15. The weldable intermetallic alloy of claim 12 further comprising one or more transition metals selected from molybdenum, titanium, tungsten, and zirconium.

16. The weldable intermetallic alloy of claim 14 containing from about 0.1% to about 0.3% molybdenum and from about 0.01% to about 0.15% zirconium.

17. The weldable intermetallic alloy of claim 15 containing from about 0.1% to about 0.3% molybdenum and from about 0.01% to about 0.15% zirconium.

18. A weldable intermetallic alloy comprising in atomic percent, an FeAl iron aluminide containing more than about 30% up to about 40% aluminum alloyed with no more than about 0.04% boron, from about 0.1% to about 0.5% carbon and the balance iron, wherein the atomic weight ratio of boron to carbon in the alloy is from about 0.01:1 to about 0.08:1.

19. The weldable intermetallic alloy of claim 18 further comprising from about 0.01% to about 3.5% of a transition metal selected from Group IVB, VB, and VIB elements.

20. The weldable intermetallic alloy of claim 19 wherein the transition metal is selected from chromium, molybdenum, niobium, titanium, tungsten, and zirconium.

21. The weldable intermetallic alloy of claim 18 containing from about 0.1% to about 0.3% molybdenum and from about 0.01% to about 0.15% zirconium.

22. The weldable intermetallic alloy of claim 20 containing from about 0.1% to about 0.3% molybdenum and from about 0.01% to about 0.15% zirconium.

23. A corrosion-resistant intermetallic alloy comprising, in atomic percent, more than about 30% up to about 40% aluminum alloyed with from about 0.1% to about 0.5% carbon, no more than about 0.04% boron such that the atomic weight ratio of boron to carbon in the alloy is in the range of from about 0.01:1 to about 0.08:1, from about 0.01% to about 3.5% of one or more transition metals selected from Group IVB, VB, and VIB elements and the balance iron wherein the alloy exhibits improved resistance to hot cracking during welding.

24. The iron-aluminide alloy of claim 23 containing up to about 0.1% to about 0.3% molydenum and from about 0.01% to about 0.15% zirconium.

25. The iron-aluminide alloy of claim 24 containing up to about 2% niobium.

26. The iron-aluminide alloy of claim 24 containing up to about 3% chromium.

* * * * *